US012698642B2

(12) United States Patent
Munir et al.

(10) Patent No.: US 12,698,642 B2
(45) Date of Patent: Aug. 4, 2026

(54) ADAPTABLE FENCE BRACING

(71) Applicant: Nez Khan, L.L.C., Manor, TX (US)

(72) Inventors: Muhammad Munir, Manor, TX (US); Boris Bass, Spring, TX (US)

(73) Assignee: Nez Khan, L.L.C., Manor, TX (US)

( * ) Notice: Subject to any disclaimer, the term of this patent is extended or adjusted under 35 U.S.C. 154(b) by 246 days.

(21) Appl. No.: 18/740,167

(22) Filed: Jun. 11, 2024

(65) Prior Publication Data

US 2024/0344352 A1 Oct. 17, 2024

Related U.S. Application Data

(63) Continuation-in-part of application No. 18/510,405, filed on Nov. 15, 2023, now abandoned, which is a continuation of application No. 18/324,813, filed on May 26, 2023, now Pat. No. 11,859,400, which is a continuation of application No. 18/041,374, filed as application No. PCT/US2022/072009 on Apr. 29, 2022, now Pat. No. 11,859,399.

(60) Provisional application No. 63/306,388, filed on Feb. 3, 2022, provisional application No. 63/182,260, filed on Apr. 30, 2021.

(51) Int. Cl.
*E04H 17/14* (2006.01)

(52) U.S. Cl.
CPC ..... *E04H 17/1448* (2021.01); *E04H 17/1452* (2021.01); *E04H 17/1488* (2021.01)

(58) Field of Classification Search
CPC . E04H 17/14; E04H 17/1413; E04H 17/1447; E04H 17/1452; E04H 17/1473; E04H 17/1486; E04H 17/1488
See application file for complete search history.

(56) References Cited

U.S. PATENT DOCUMENTS 3,491,985 A * 1/1970 Grimsley ..... E04H 12/2215 52/155
3,524,627 A * 8/1970 Boyanton ..... E04H 17/1413 248/316.1
4,979,724 A * 12/1990 Williams ..... E04H 17/08 403/374.2
5,022,327 A * 6/1991 Solomon ..... A47B 23/046 108/147

(Continued)

*Primary Examiner* — Jonathan P Masinick
(74) *Attorney, Agent, or Firm* — Thompson Patent Law Offices PC

(57) ABSTRACT

Apparatus and associated methods relate to fence bracing apparatus having a tension adjusting modules to diagonally brace a fence posts and/or adaptive fence brackets for flexibly bracing the fence posts for various fence configurations and for attachment of various accessories. In an illustrative example, a fence tensioning module may include a tension regulation module coupled to a tension adjusting link. For example, the fence tensioning module may adjust the position of the tension adjusting link relative to the fence tensioning module so that a tension of the tension adjusting link is adjusted. The adaptive fence bracket, for example, may include a butterfly clamp and an adaptive C-bracket having two sidearms configured to couple, for example, to fence rails and/or other tension members to form various fence bracing configurations. Various implementations may advantageously provide adaptive and secure fence construction and provide options to install accessories.

23 Claims, 29 Drawing Sheets

(56) References Cited

U.S. PATENT DOCUMENTS

| | | | | | |
|---|---|---|---|---|---|
| 5,046,705 | A * | 9/1991 | Williams | E01F 7/02 | 256/70 |
| 5,192,055 | A * | 3/1993 | Griggs | E04H 17/23 | 256/DIG. 5 |
| 5,224,241 | A * | 7/1993 | Williams | A01K 1/0017 | 16/253 |
| 5,816,116 | A * | 10/1998 | Antony | F16H 57/033 | 74/606 R |
| 5,890,438 | A * | 4/1999 | Frankish | A47B 17/02 | 108/50.02 |
| 6,443,433 | B1 * | 9/2002 | Auldridge | E04H 17/1413 | 256/69 |
| 6,883,785 | B1 * | 4/2005 | Knapp | E04H 17/08 | 256/10 |
| 8,770,063 | B2 * | 7/2014 | Bhatti | F16H 57/039 | 74/606 R |
| 9,115,506 | B2 * | 8/2015 | Hill | E04H 17/1417 | |
| 9,631,770 | B2 * | 4/2017 | Holestine | E04H 17/1417 | |
| D847,607 | S * | 5/2019 | Granberg | D8/349 | |
| 11,371,256 | B1 * | 6/2022 | Lyons | E04H 17/1417 | |
| 2013/0104494 | A1 * | 5/2013 | Evangelista | F16B 7/0473 | 403/291 |
| 2014/0264220 | A1 * | 9/2014 | Doyle | E04H 17/1417 | 256/65.06 |
| 2017/0167160 | A1 * | 6/2017 | Beisser, III | E04H 17/266 | |
| 2019/0128014 | A1 * | 5/2019 | Hiner | E04H 17/08 | |
| 2020/0270895 | A1 * | 8/2020 | Stinson | E04H 17/06 | |
| 2021/0079685 | A1 * | 3/2021 | Beisser, III | E04H 17/22 | |
| 2022/0120113 | A1 * | 4/2022 | Schueren | E04H 17/263 | |

* cited by examiner

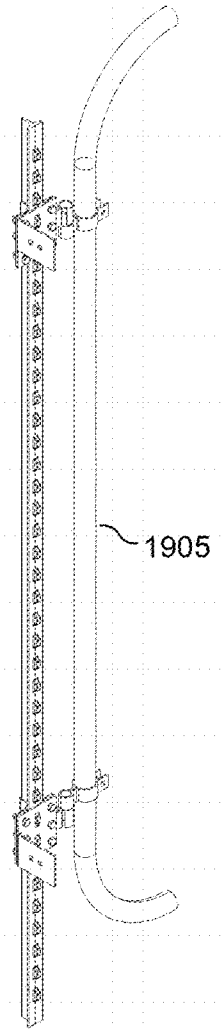
FIG. 19A
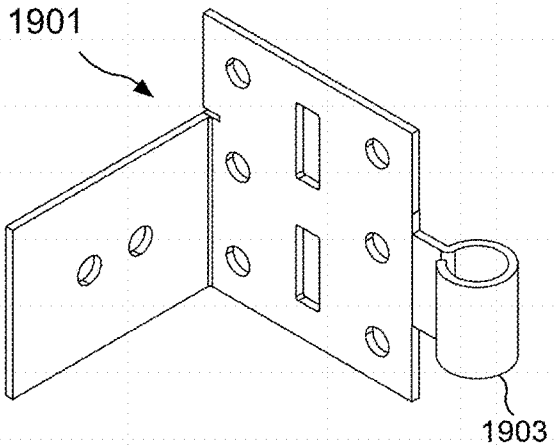
FIG. 19B
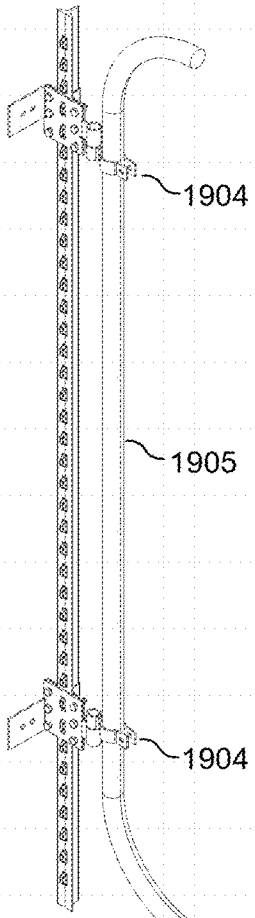
FIG. 19C
FIG. 19D

ADAPTABLE FENCE BRACING

CROSS-REFERENCE TO RELATED APPLICATIONS

This application is a Continuation-in-part of application and claims benefit of application Ser. No. 18/510,405 titled "adaptable fence bracing" filed by Muhammad Munir, et al., on Nov. 15, 2023 which is a Continuation and claims the benefit of U.S. application Ser. No. 18/324,813, titled "Adaptable Fence Bracing," filed by Muhammad Munir, et al., on May 26, 2023, which application is a Continuation and claims the benefit of U.S. application Ser. No. 18/041,383, titled "Adaptable Fence Bracing," filed by Muhammad Munir, et al., on Feb. 10, 2023, which application is a national stage application under 35 USC 371 of PCT Application Serial No. PCT/US2022/072009, titled "Adaptable Fence Bracing," filed by Muhammad Munir, et al., on Apr. 29, 2022, which application claims the benefit of U.S. Provisional Application Ser. No. U.S. 63/182,260, titled "Adaptable Fence Bracing," filed by Muhammad Munir, on Apr. 30, 2021 and of U.S. Provisional Application Ser. No. 63/306,388, titled "Versatile Fence Bracing," filed by Muhammad Munir on Feb. 3, 2022. This application incorporates the entire contents of the foregoing applications herein by reference.

TECHNICAL FIELD

Various implementations relate generally to fencing and/or bracing, such as fence bracing.

BACKGROUND

Perimeter fences of farms, pastures, ranches, and other entities are often made with vertically erected support members such as T-posts and/or wood posts. The posts may be used, for example, to support metal wire fences and/or barbed wires. The vertically erected support members may, for example, need to be braced at the ends of fences, at certain intervals, and/or at the corners and T-junctions to create strength and stability. T-posts may be, for example, steel posts which may be hammered into the ground. Wood posts may, for example, require post-holes to be dug manually or with help of equipment and/or may be driven (e.g., by a hydraulic ram). Posts of many types, including wood posts and T-posts often are vulnerable to distortion and collapse if not braced adequately.

SUMMARY

Apparatus and associated methods relate to fence bracing apparatus having a tension adjusting modules to diagonally brace a fence posts and/or adaptive fence brackets for flexibly bracing the fence posts for various fence configurations and for attachment of various accessories. In an illustrative example, a fence tensioning module may include a tension regulation module coupled to a tension adjusting link. For example, the fence tensioning module may adjust the position of the tension adjusting link relative to the fence tensioning module so that a tension of the tension adjusting link is adjusted. The adaptive fence bracket, for example, may include a butterfly clamp and an adaptive C-bracket having two sidearms configured to couple, for example, to fence rails and/or other tension members to form various fence bracing configurations. Various implementations may advantageously provide adaptive and secure fence construction and provide options to install accessories.

Various implementations may achieve one or more advantages. Some implementations, for example, may include a pinch portion between the butterfly clamp and the bracket to create a space to advantageously adaptively clamp to multiple sizes of fence posts. Some implementations, for example, may include apertures of various sizes which may advantageously adaptively couple to fence rails and/or diagonal connection links connecting two or more adjacent fence posts. For example, some implementations may include a gearbox to increase precision and/or ease in altering the tension at the tension adjusting link. For example, some implementations may include a lock unit to secure the tension at the tension adjusting link. Some implementations, for example, may include a threaded receiving channel to threadedly couple to a threaded rod. Some implementations, for example, may include a crank handle to easily adjust the tension at the tension adjusting link.

The details of various implementations are set forth in the accompanying drawings and the description below. Other features and advantages will be apparent from the description and drawings, and from the claims.

BRIEF DESCRIPTION OF THE DRAWINGS

FIG. 19A and FIG. 19B depict perspective views of an exemplary modified C-bracket-3A and 3B with one sidearm of each trimmed and curved to a partial circle to receive the axle of a door hinge.

FIG. 19C and FIG. 19D show the axles of door hinges inserted in the curved sidearms of exemplary modified C-bracket-3A and 3B, the door hinges holding a metal pipe door frame.

Like reference symbols in the various drawings indicate like elements.

DETAILED DESCRIPTION OF ILLUSTRATIVE IMPLEMENTATIONS

To aid understanding, this document is organized as follows. First, to help introduce discussion of various implementations, an exemplary easy robust fence bracing system for quickly and securely brace a fence is introduced with reference to FIG. 1. Second, that introduction leads to a description with reference to FIGS. 2-4 of some exemplary implementations of a fence bracing gearbox. Third, with reference to FIGS. 5-7C, various implementations of an exemplary tension adjusting module are introduced. Fourth, with reference to FIGS. 8-12, the discussion turns to exemplary implementations that illustrate various applications of an exemplary adaptive fence brace. Fifth, and with reference to FIGS. 13A-15C, this document describes exemplary apparatus and methods useful for installing a secured fence using the easy robust fence bracing system. Finally, the document discusses further implementations, exemplary applications and aspects relating to an easy robust fence bracing system.

Figure 1:
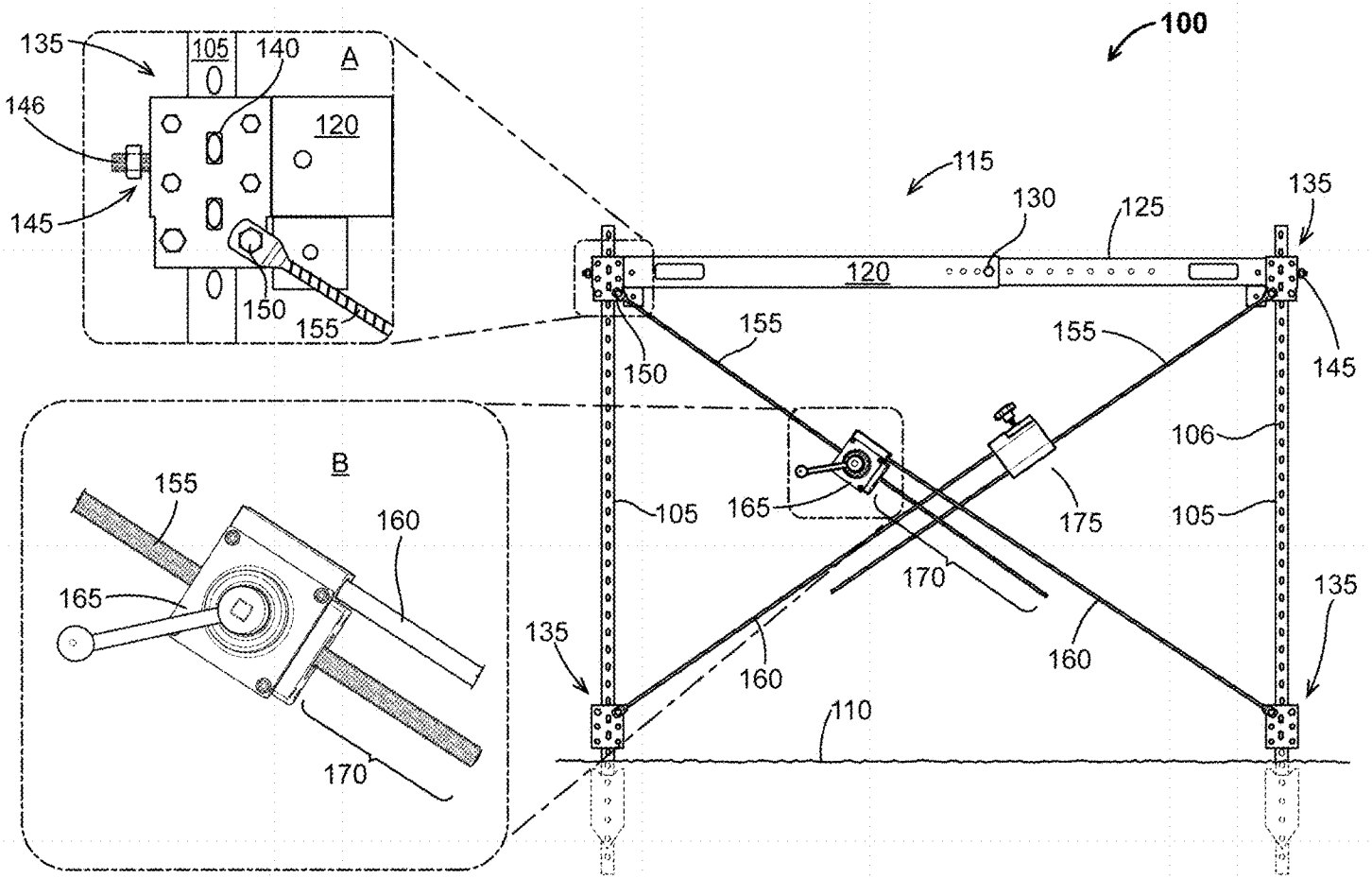
FIG. 1 depicts an exemplary Easy Robust Fence Bracing System (ERFBS) employed in an illustrative use-case scenario.

FIG. 1 depicts an exemplary Easy Robust Fence Bracing System (ERFBS) 100 employed in an illustrative use-case scenario. For example, the ERFBS 100 may be a securely and safely constructed fence. In this example, the ERFBS 100 includes two vertical fence posts 105, partially submerged at one end into a substrate 110 (e.g., a ground). For example, the fence posts 105 may be a T-post, a Y-post, or variants of a star post. In some implementations, the fence posts 105 may be made of steel. In this example, the fence post 105 includes, along a longitudinal axis of the fence post 105, studs 106. For example, the studs 106 may prevent, for example, a wire fence (not shown) from sliding up or down the fence post 105. In some implementations, the wire fence may, by way of example and not limitation, include barbed wire. The wire fence may, for example, include high-tensile wire. In some examples, the wire fence may include net wire.

Between the fence posts 105, the ERFBS 100 includes a fence rail 115 coupled horizontally at each end to the fence post 105. In some implementations, the fence rail 115 may be adjustable in length. For example, in use, the fence rail 115 may be adjusted in length to fit various distance between the fence posts 105. In this example, the fence rail 115 includes an outer rail 120, an inner rail 125, and a coupling member 130 (e.g., a length adjustment bolt). In some implementations, at one or both sidewalls, each of the outer rail 120 and the inner rail 125 include multiple apertures spaced at intervals from an end of the rail. For example, by sliding the outer rail 120 relative to the inner rail 125 and aligning a pair of the apertures of the outer rail 120 and the inner rail 125, the fence rail 115 may be adjusted into a desired length. For example, the coupling member 130 may be used to fix the fence rail at a desired length by bolting the overlapping ends in place by fastening through the aligned apertures between the inner rail 125 and the outer rail 120.

In some implementations, the fence rail 115 may, for example, include rectangular tubing (e.g., square tubing). A first fence rail may slide, for example, within a second fence rail. In some implementations, for example, the fence rail 115 may include an open shape (e.g., an "L-shape" such as angle iron).

In the depicted example, the fence rail 115 is coupled (at opposing ends) to each of the fence posts 105 with an adaptive fence brace (AFB 135). For example, the AFB 135 may provide flexibility in arranging the connection between the fence post 105 and the fence rail 115.

As shown in a close-up diagram depicted in FIG. 1, the AFB 135 includes slots 140 configured to engage (e.g., mechanically couple) the studs 106 of the fence post 105. In some implementations, the AFB 135 may include a clamp unit and a bracket to engage the fence post 105 such that the AFB 135 is securely fastened to the fence post 105. Various implementations of the AFB 135 are further discussed with reference to FIGS. 8-12.

In the depicted example, the AFB 135 includes coupling features 145 to connect the fence post 105 with the fence rail 115. For example, the coupling features 145 may receive a fastening bolt 146 to securely connect to the fence rail 115. For example, therefore, the fence post 105 is securely connected to the fence rail 115 due to a secure engagement between the fence post 105 and the AFB 135. In various implementations, the AFB 135 may provide more than one way for engaging the fence post 105. Accordingly, the AFB 135 may, in some examples, advantageously provide flexibility in constructing the ERFBS 100.

The AFB 135 also includes coupling features 150 to diagonally couple to the adjacent fence post 105 via a tension adjusting rod 155. In some implementations, by connecting to the adjacent fence post 105, the ERFBS 100 may have additional reinforcement against rotational force (e.g., 'torque' or moment) against the ERFBS 100.

As shown in this example, the ERFBS 100 includes a Fence Bracing Gearbox (FBGB 165). The FBGB 165 connects, in this example, two adjacent fence posts 105 diagonally by coupling the tension adjusting rod 155 and a coupling member 160 (e.g., a connecting link). For example, the FBGB 165 may be used to adjust tension between the fence posts 105 to advantageously improve reinforcement and stability. In some examples, a tension of the ERFBS 100 may be reduced after being used for some time due to, for example, weather condition and/or other outside disturbance. For example, the ERFBS 100 with reduced tension may have reduced strength. In some implementations, the FBGB 165 may be used to re-adjust the tension between the fence posts 105 to keep the fence strength at the desired level.

In this example, the FBGB 165 further receives the coupling member 160 at a fixed length between the fence post 105 (in connection with the coupling member 160) and the FBGB 165. As shown in the zoom-in diagram B in FIG. 1, the FBGB 165 receives the tension adjusting rod 155 though the FBGB 165. As shown, a through length 170 may be allowed through the FBGB 165. In some implementations, the FBGB 165 may adjust a tension between the two adjacent fence posts 105 by adjusting the through length 170. For example, the tension between the fence posts 105 may be tightened by increasing the through length 170. For example, the tension between the fence posts 105 may be loosened by decreasing the through length 170.

In some implementations, the FBGB 165 may further include a locking unit. For example, the locking unit may be a nut threading along the tension adjusting rod 155. In some implementations, the locking unit may be tightened against the FBGB 165 to secure the through length 170 of the tension adjusting rod 155.

The ERFBS 100 includes a tension adjusting brace 175. As shown, the tension adjusting brace 175 may provide a tension adjusting function without using a gearbox.

Figure 2A:
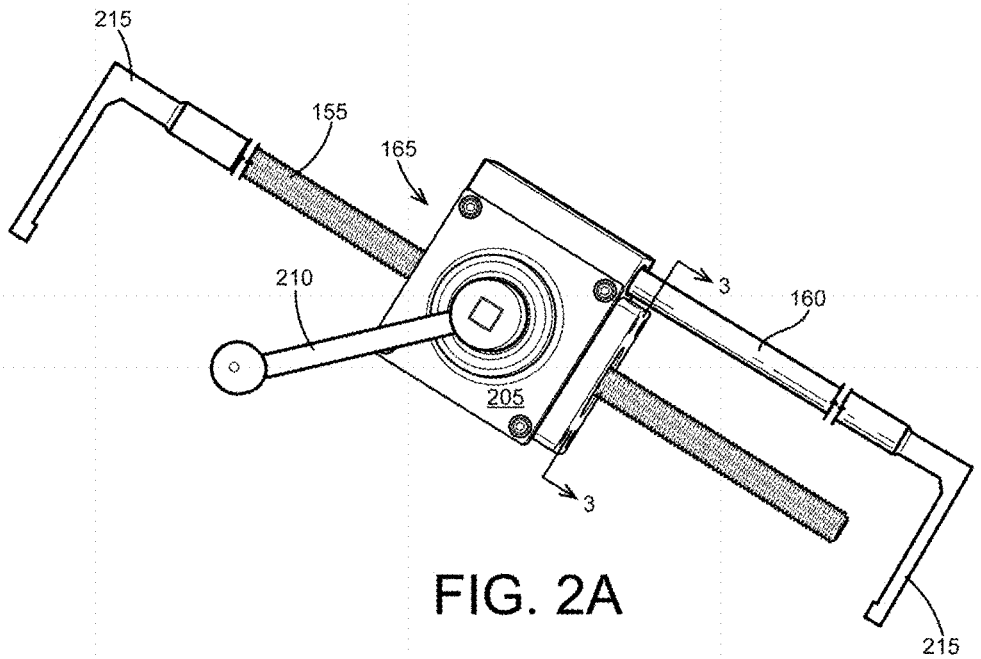
FIG. 2A and FIG. 2B depicts an exemplary Fence Bracing Gearbox (FBGB) coupled to an exemplary tension adjusting rod and an exemplary coupling member, with hook ends (FIG. 2A) and engagement ends (FIG. 2B).
Figure 2B:
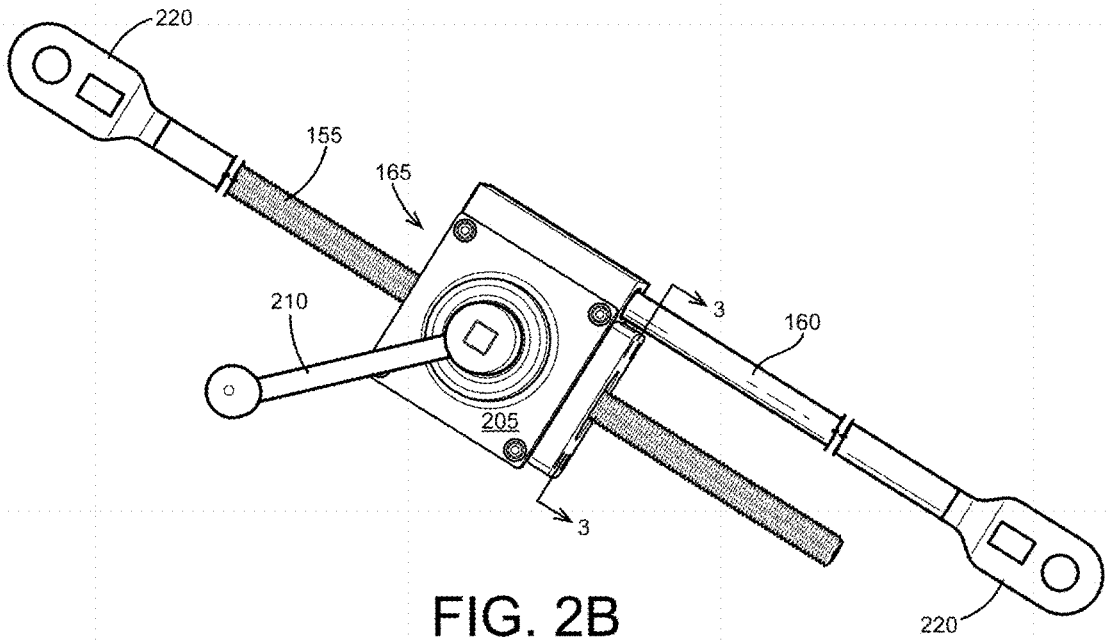

FIG. 2A and FIG. 2B depict an exemplary FBGB 165 coupled to an exemplary tension adjusting rod 155 and an exemplary coupling member 160, with hook ends (FIG. 2A) and engagement ends (FIG. 2B). For example, the tension adjusting rod 155 may be a threaded shaft. For example, the tension adjusting rod 155 may be connecting on one end to the fence post 105. For example, the coupling member 160 may be connecting diagonally to another fence post. The coupling member 160 is received at a gearbox housing 205. The FBGB 165 further includes a handle 210 for operating an internal gear system (not shown). For example, the internal gear system may be used to regulate a relative position of the tension adjusting rod 155 to the FBGB 165.

The tension adjusting rod 155, in this example, is a fully threaded rod. In other implementations, the tension adjusting rod 155 may be a partially threaded rod that is threaded at an end portion. In some examples, the tension adjusting rod 155 may be partially threaded so that it is easy to grip at either end of the tension adjusting rod 155.

A rod (e.g., 155, 160) may be provided with a terminal end (e.g., at a distal end relative to the FBGB 165). In the depicted example in FIG. 2A, a distal end of the tension adjusting rod 155 and the coupling member 160 are each provided with a hook end 215. For example, the hook end 215 may be used to engage a post and/or an AFB 135. Accordingly, for example, a user may apply the FBGB as a reusable tensioning tool to apply tension to a fence (e.g., a brace, wire). For example, the user may use the FBGB 165 to tension the fence, and then apply a diagonal bracing rod, a tension adjusting brace 175, wire, and/or cable.

In the depicted example in FIG. 2B, a distal end of the tension adjusting rod 155 and the coupling member 160 are each provided with an engagement end 220. The engagement end 220, as depicted, may be configured to be coupled (e.g., by a pin, screw, and/or bolt) to an AFB 135, for example. For example, the FBGB 165 may be installed (e.g., permanently, semi-permanently) as an adjustable tension fence bracing module (e.g., diagonal fence brace).

The terminal ends (e.g., 215, 220) may be releasably coupled to the respective rod(s). For example, a terminal end may be threaded to receive the distal end of the corresponding rod. In some implementations, a terminal end may be fixedly coupled (e.g., welded) to the rod. In some implementations, a terminal end may be pinned to a rod. Some implementations may, by way of example and not limitation, be rotatably coupled (e.g., by a swivel joint such as a swaged swivel joint) to the rod. Implementations with a swivel joint may, for example, advantageously enable repositioning of the FBGB 165 to a desired orientation for operation.

In some examples, various materials may be used to make one or more components. For example, the tension adjusting rod 155 may be made in aluminum for better durability and less weight. In some examples, the tension adjusting rod 155 may be made in brass rods for higher corrosion resistivity. Other metal materials, such as steel, titanium, bronze, and/or copper may be used, in some implementations. In some implementations, polymers and/or fiber reinforced polymers (e.g., carbon fiber, fiberglass), for example, may be used.

Figure 3:
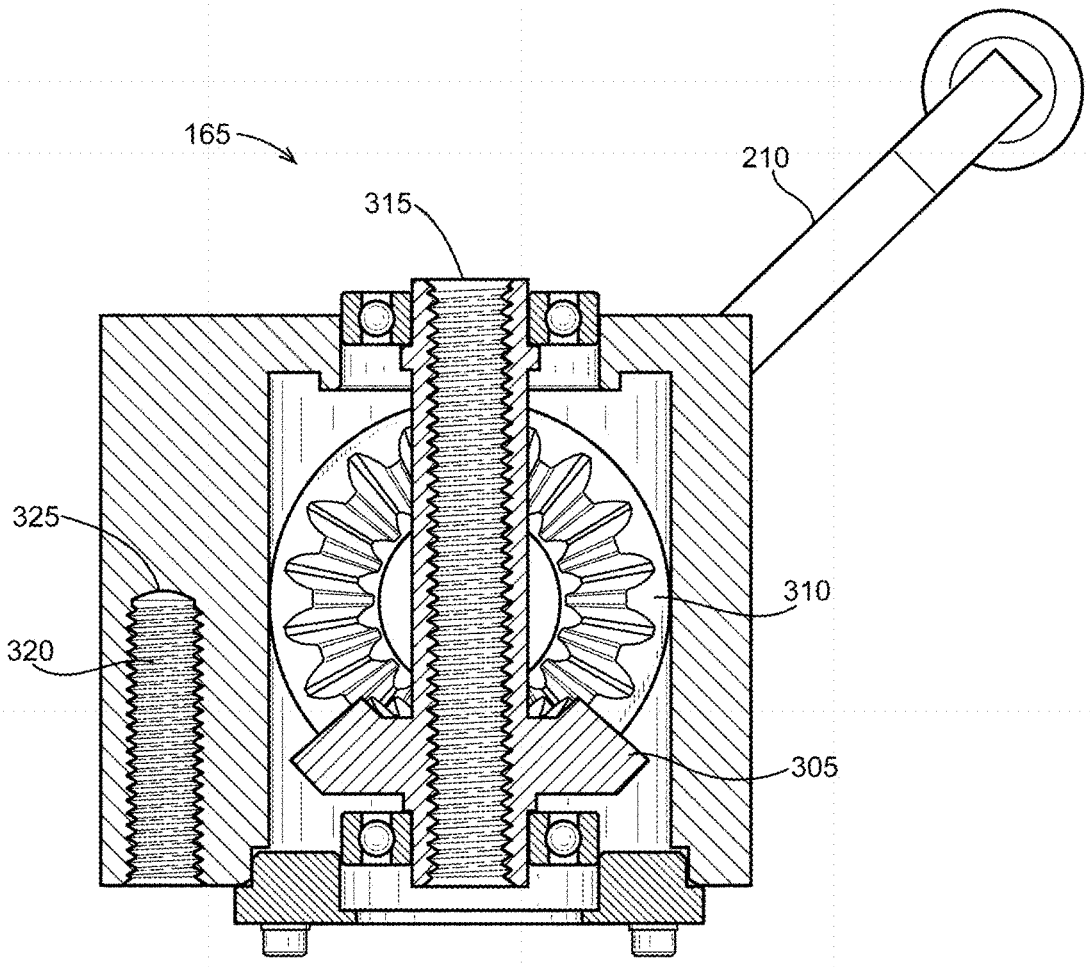
FIG. 3 is a cross section-view of the FBGB 165 as described with reference to FIGS. 2A-2B.

FIG. 3 is a cross section-view of the FBGB 165 as described with reference to FIGS. 2A-2B. In this example, the FBGB 165 includes a ring gear 305 operably coupled to a pinion gear 310. For example, a rotation of the pinion gear 310 may induce a corresponding rotation at the ring gear 305.

In this example, the pinion gear 310 operably couple to the handle 210. For example, a rotational motion at the handle 210 may induce rotation at the pinion gear 310, which, in turn, may induce rotations at the ring gear 305.

As shown, the FBGB 165 includes a threaded lumen 315 for receiving the tension adjusting rod 155. For example, the tension adjusting rod 155 may be rotatably inserted into the threaded lumen 315. In some implementations, at least part of the threaded lumen 315 may be driven by the ring gear 305. For example, the ring gear 305 may rotate a part of the threaded lumen 315 to regulate a relative position of the tension adjusting rod 155 to the FBGB 165.

The FBGB 165 includes a bracing chamber 320 configured to releasably couple to the coupling member 160. In some implementations, the bracing chamber 320 may be threaded to securely receive the coupling member 160. In some implementations, the bracing chamber 320 may include friction inducing material to secure the coupling member 160 in place. As shown, the bracing chamber 320 may receive the coupling member 160 at a substantially parallel axis to the threaded lumen 315.

The bracing chamber 320 includes a soft stop unit 325. In some implementations, during insertion of the coupling member 160 into the bracing chamber 320, the soft stop unit 325 may advantageously provide tension relief to avoid damage to the bracing chamber due to excessive tension. In some implementations, the soft stop unit 325 may be a rubber stop. In some implementations, the soft stop unit 325 may be a coil spring.

Figure 4:
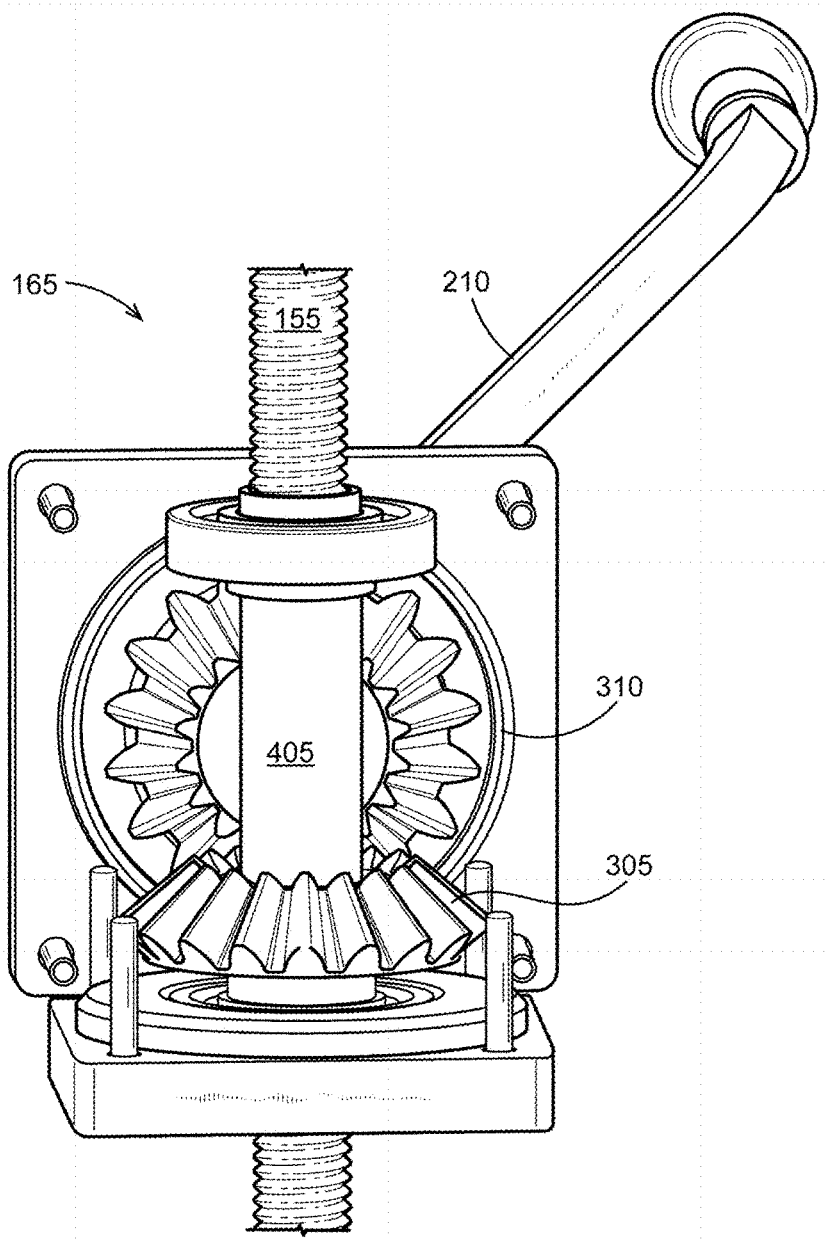
FIG. 4 shows an exemplary gear arrangement of the FBGB as described with reference to FIGS. 2A-2B.

FIG. 4 shows an exemplary gear arrangement of the FBGB 165 as described with reference to FIGS. 2A-2B. In this figure, the housing 205 is removed for better view of the internal gear system. The ring gear 305 includes an extended bore 405 to receive the tension adjusting rod 155. For example, the extended bore 405 may be configured to threadedly engage the tension adjusting rod 155.

In operation, the handle 210 may be operated to turn the pinion gear 310. The pinion gear 310, having an axis of rotation substantially perpendicular to the ring gear 305, may induce a rotation at the ring gear 305 such that the extended bore 405 may concentrically engage the tension adjusting rod 155. For example, the relative position of the tension adjusting rod 155 to the FBGB 165 may be altered. In some examples, the tension between the fence posts connected by the FBGB 165 may be advantageously selectively regulated.

In various implementations, during a setup of the ERFBS 100, the FBGB 165 may selectively operate in a sliding mode in which the tension adjusting rod 155 is permitted to slide in the threaded lumen 315 along a first longitudinal axis. The FBGB 165 may operate, in some implementations, in a threading mode in which the ring gear 305 threadedly couples tension adjusting rod 155 to the FBGB 165. In some examples, the ring gear 305 may be rotated operably by the handle 210 to selectively adjust the tension at the FBGB 165. After a desired tension is reached, in some implementations, the FBGB 165 may operate in a locking mode in which the locking unit clamps the tension adjusting rod in a static position relative to the FBGB 165. In some implementations, the FBGB 165 may not include a sliding mode.

Figure 5:
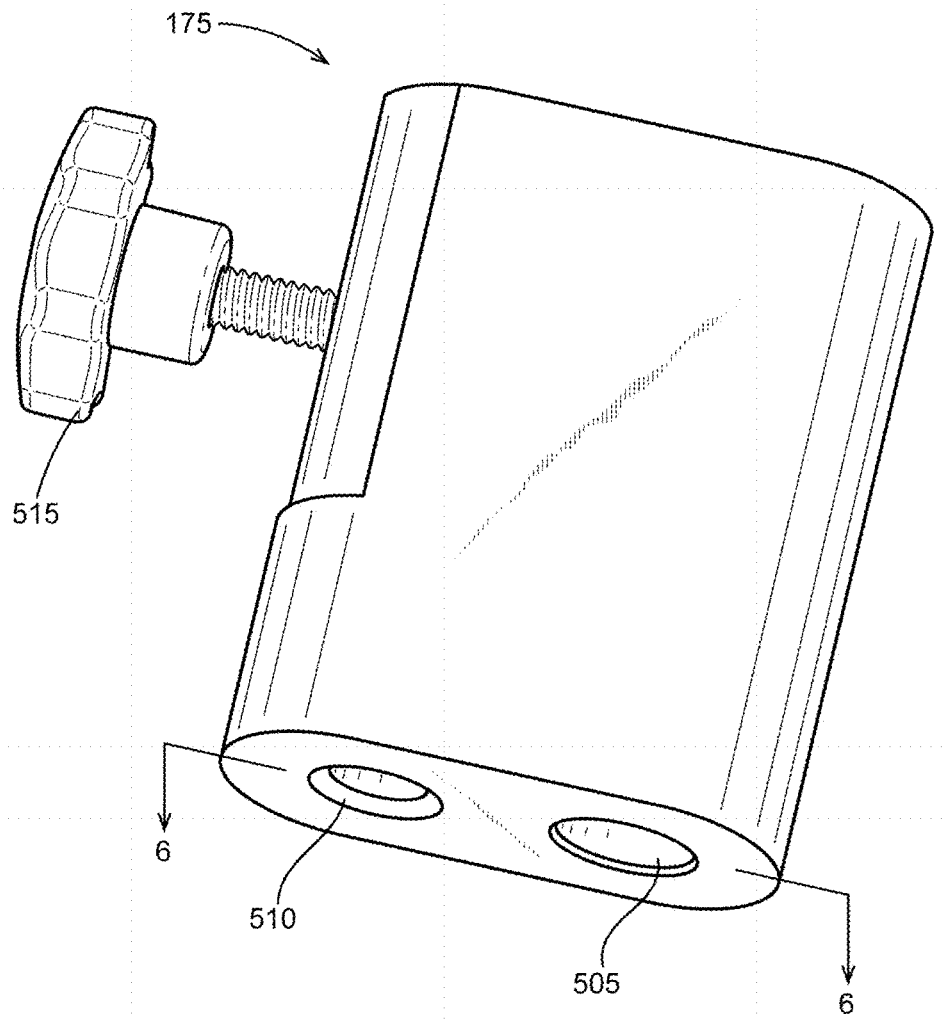
FIG. 5 depicts a perspective view of an exemplary tension adjusting brace.

FIG. 5 depicts a perspective view of an exemplary tension adjusting brace 175. In various examples, the tension adjusting brace 175 may be used in place of the FBGB 165 in FIG. 1. As shown in, the tension adjusting brace 175 includes a channel 505 for receiving the tension adjusting rod 155, and a chamber 510 for receiving the coupling member 160. In this example, the tension adjusting brace 175 further includes a turning member 515 (e.g., a knob, as depicted). In some implementations, the turning member 515 may, for example, be configured as a bolt. For example, the turning knob may be operable by a tool (e.g., a wrench). The turning knob may, for example, omit a handgrip in some implementations.

Figure 6:
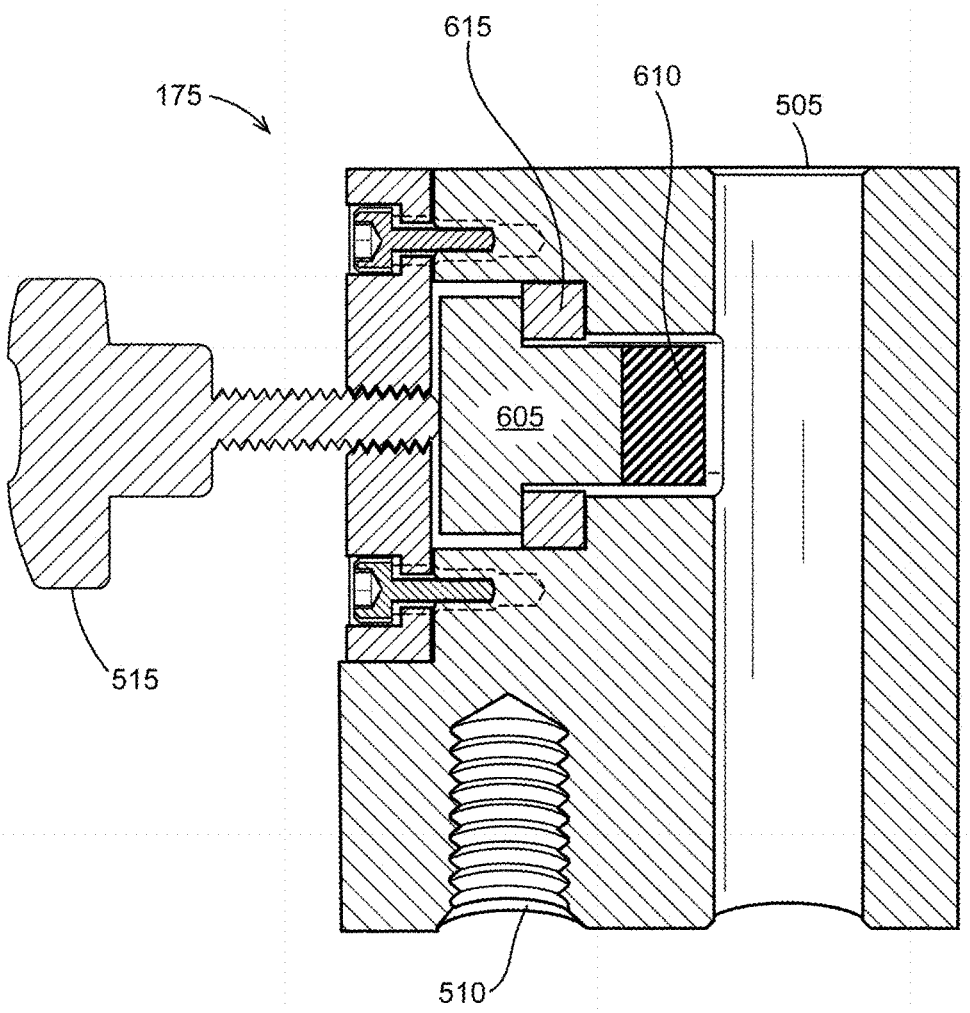
FIG. 6 depicts a cross-section diagram of the tension adjusting brace as described in FIG. 5.

FIG. 6 depicts a cross-section diagram of the tension adjusting brace 175 as described in FIG. 5. As shown, the turning member 515 has a threaded shaft operably engaging a clamping block 605. For example, rotations of the turning member 515 may induce the clamping block 605 to move in an axis perpendicular to a longitudinal axis along the channel 505. In some examples, when the channel 505 receives the tension adjusting rod 155, the clamping block 605 may engage and prevent the tension adjusting rod 155 from sliding. In various implementations, the clamping block 605 may be threaded to advantageously exert a firm grip on the threaded tension adjusting rod 155.

In the depicted example, the clamping block 605 may, be at least partially elastomeric. For example, the clamping block 605 may include at least one terminal pad 610 and terminal pad 615 (e.g., natural rubber, vulcanized rubber, polyurethane). In some implementations, the terminal pad may, by way of example and not limitation, be formed from Shore D 60-80 durometer material. Such a relatively rigid rubber may advantageously resist rotation and/or axial displacement of the tension adjusting rod 155 when the clamping block 605 is operated into a locked mode. In some implementations, the terminal pad 610 may, for example, be a metal (e.g., deformable under a predetermined clamping pressure). The terminal pad 610 may, for example, be aluminum (e.g., 6010 aluminum), brass, and/or copper.

In some implementations, the terminal pad 610 may, for example, be threaded. The terminal pad 615 may, for example, regulate a maximum clamping force. A space tolerance between the clamping block 605 and the corresponding cavity in the brace 175 may, for example, permit the clamping block 605 to move axially (e.g., parallel to the channel 505) during engagement of the at least one terminal pad 610 with a (threaded) rod (e.g., to permit threads of the terminal pad 610 to engage threads of the rod).

In some implementations, in a tension adjusting operation, a desired tension may be achieved by sliding the tension adjusting rod 155 to a desired length relative to the tension adjusting brace 175. In some examples, the turning members 515 can be turned to increase friction between the clamping block 605 and the tension adjusting rod 155. For example, the tension adjusting rod 155 may be prevented from sliding when the friction is above a (predetermined) threshold. Accordingly, for example, the tension adjusting brace 175 may provide an alternative option for regulating the tension at the tension adjusting rod. In some implementations, the tension adjusting brace 175 may advantageously provide a more affordable alternative for diagonally bracing the fence posts 105.

In some implementations, terminal ends of the rod(s) may be provided with swivel joint(s), such as discussed with respect to FIGS. 2A-2B. In such implementations, for example, the terminal ends of the rods may be engaged with opposite ends to be braced (e.g., a first post and a second post). The turning member 515 may be operated such that the clamping block 605 is in a sliding mode (e.g., allowing a rod to slide axially through the channel 505). For example, a coefficient of friction and/or normal force is below a corresponding predetermined threading threshold Tt.

Once the rod is in a desired position, the turning member 515 may be operated such that the clamping block 605 is in a threading mode (e.g., engaging the rod such that a coefficient of friction and/or normal force is above the corresponding Tt and below a corresponding predetermined clamping threshold Tc). The rod and/or the brace 175 may be rotated relative to one another such that the rod is axially translated, relative to the brace 175, along a longitudinal axis of the channel 505. Accordingly, the rod may advantageously be threaded to apply, for example, a desired tension to the rod(s). Once a desired tension is achieved, the turning member 515 may be operated such that the clamping block 605 is in a clamping mode. For example, a coefficient of friction and/or a normal force may be above the corresponding Tc. For example, Tc>Tt. Accordingly, a user may advantageously quickly position a rod in a sliding mode, generate a desired tension in a threading mode, and then clamp the rod in place.

Figure 7A:
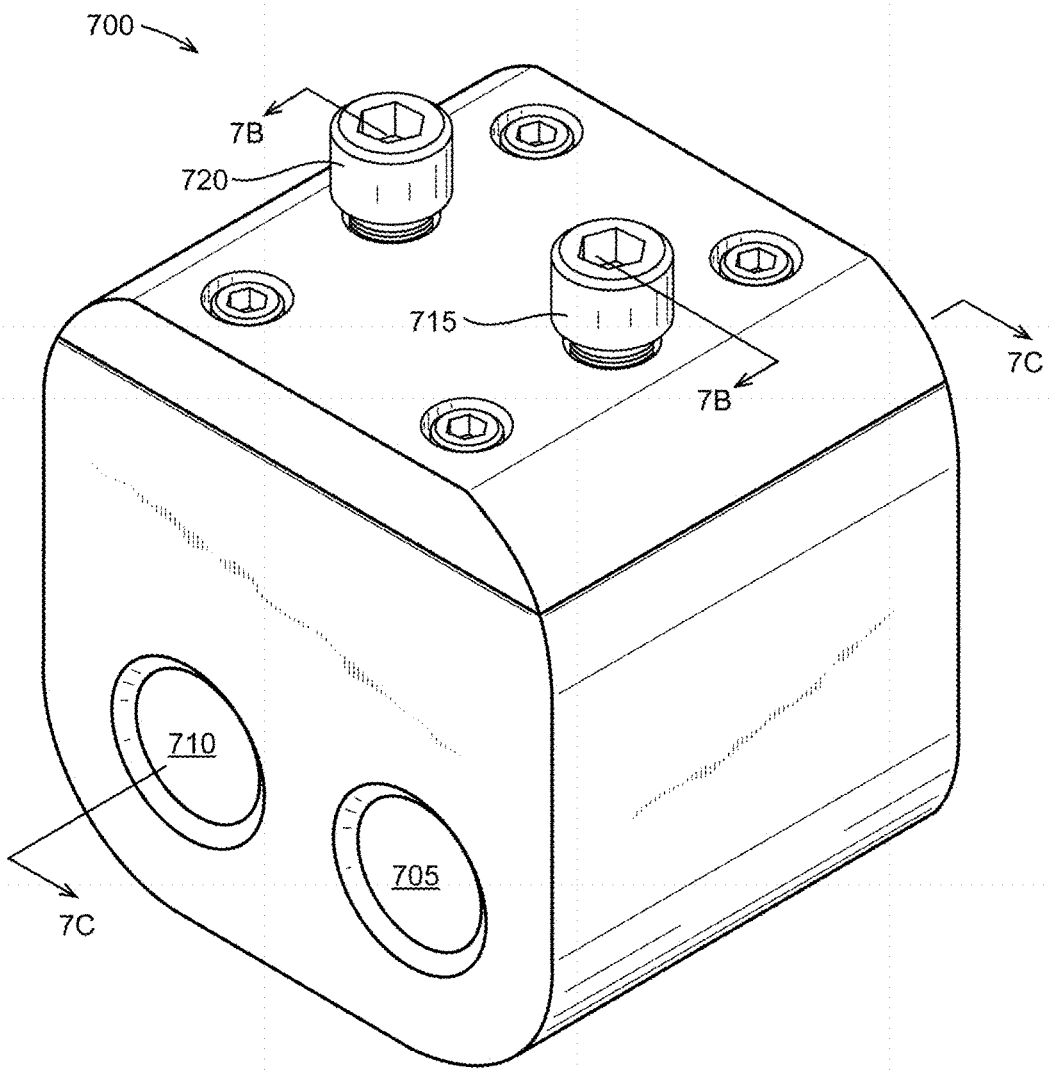
FIG. 7A shows an exemplary tension adjusting brace having two receiving channels.

FIG. 7A shows an exemplary tension adjusting brace 700 having two receiving channels 705, 710. In some implementations, the ERFBS 100 may include two tension adjusting rods 155 diagonally coupled to the tension adjusting brace 700. In some examples, the tension adjusting brace 700 may adjust tension of each of the tension adjusting rods 155 received by adjusting a relative position between the tension adjusting brace 700 and the corresponding tension adjusting rods 155. The tension adjusting brace 700 further includes two control members 715, 720. In some implementations, the control members 715, 720 may be a hexagonal socket. For example, the control members 715, 720 may be controlled by inserting and rotating a hexagonal wrench (e.g., an Allen wrench such as a Z-Allen wrench).

Figure 7B:
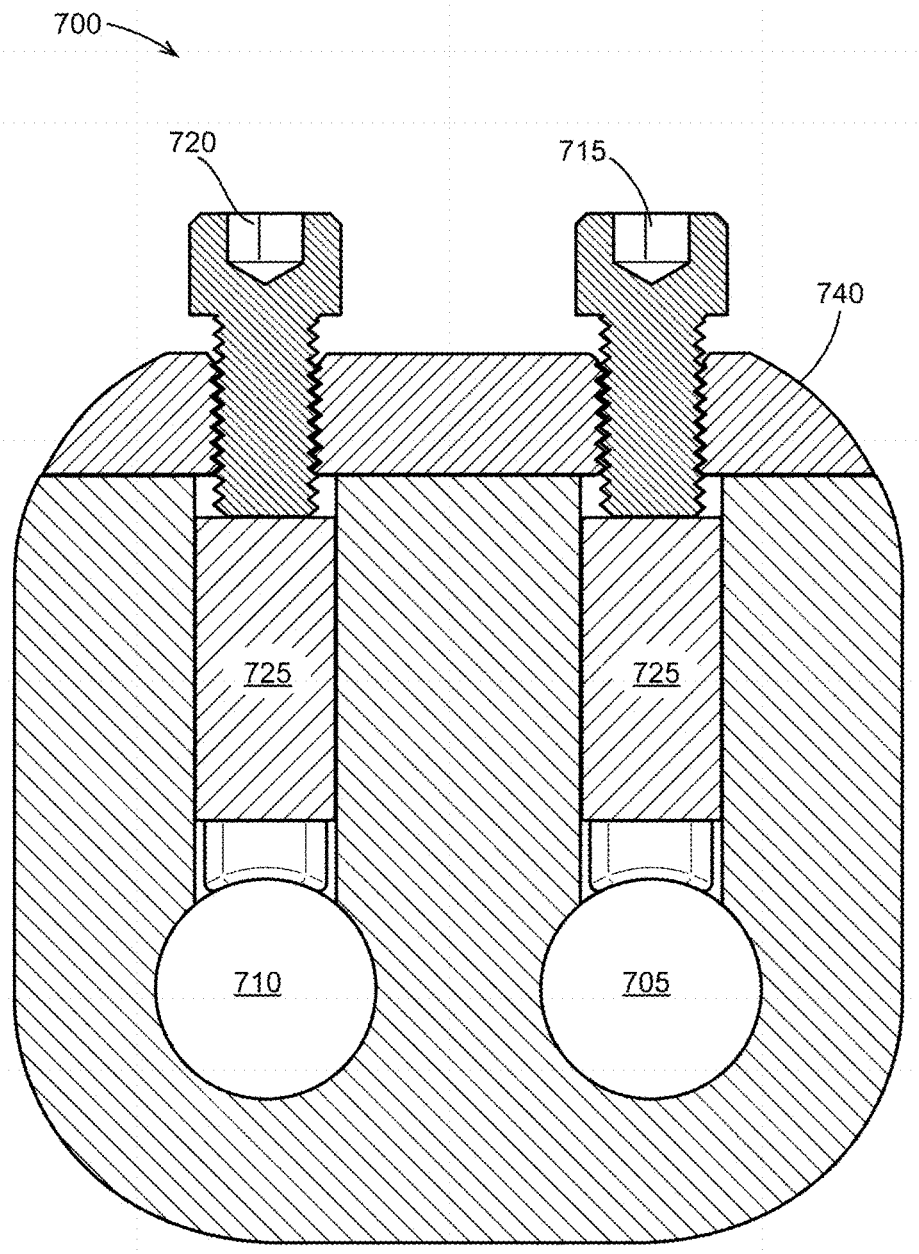
FIG. 7B shows a cross-section view of the exemplary tension adjusting brace as described in FIG. 7A.
Figure 7C:
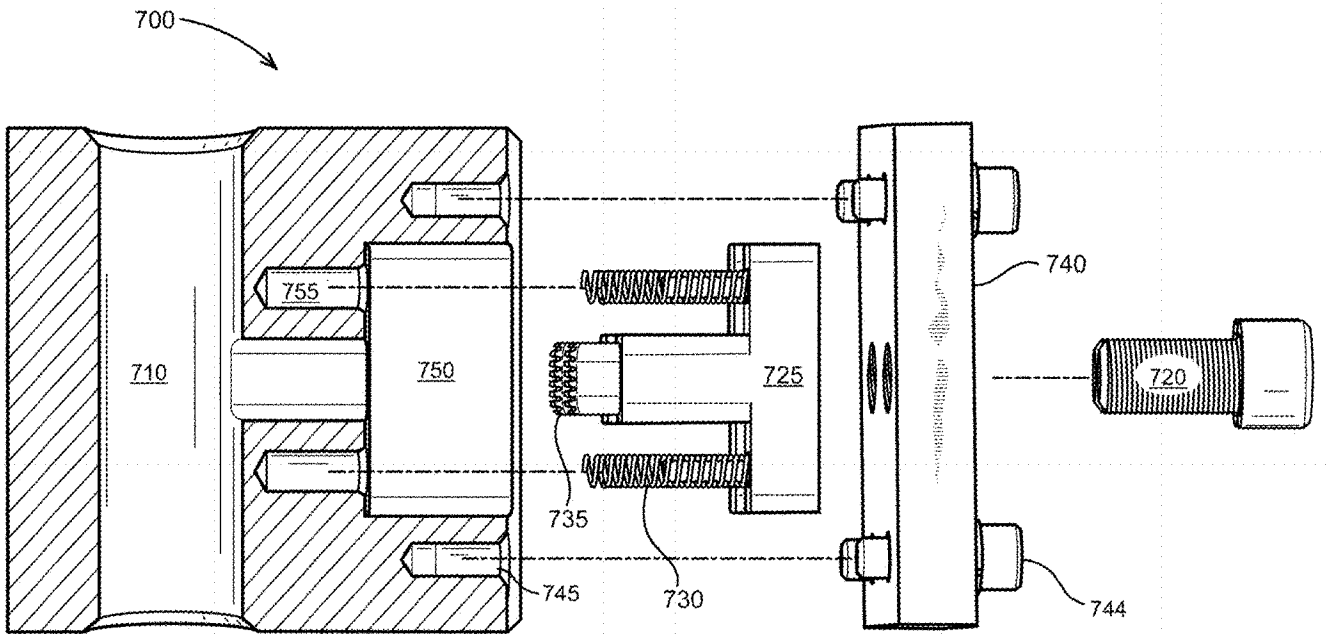
FIG. 7C shows an exploded view of the exemplary tension adjusting brace as described in FIG. 7A

FIG. 7B shows a cross-section view of the exemplary tension adjusting brace 700 as described in FIG. 7A. FIG. 7C shows an exploded view of the exemplary tension adjusting brace 700 as described in FIG. 7A. In this example, the tension adjusting brace 700 includes, for each of the channels 705, 710, clamping blocks 725. Each of the clamping blocks 725 may be used to hold a received tension adjusting rod. Each of the clamping blocks 725 may be in pressing contact, in this example, with the corresponding control members 715, 720 (depicted as bolts with sockets). In various examples, the spring coil 730 may be received in a tension relief chamber 755 such that excess tension is avoided to prevent damage to the tension adjusting rods or the tension adjusting brace 700. The spring coil 730 may, for example, urge the clamping blocks 725 away from the channels 705 such that a vertical position of the clamping blocks 725 is determined by a position of the control members 715, 720 in a block top 740 (e.g., through a threaded hole, as depicted).

As depicted, the block top 740 is coupled (e.g., releasably) to the body of the brace 700 by fasteners 744 (e.g., press-fit, threaded) engaging cavities 745 (e.g., threaded, sized to pressingly receive the fasteners). A cavity 750 is configured to (slidingly) receive the clamping blocks 725 into the body of the brace 700.

In some implementations, the clamping blocks 725 may, for example, be configured as disclosed at least with reference to the clamping block 605. In some implementations, for example, the clamping blocks 725 may include corresponding rubber pads. In some implementations, such as depicted, the clamping blocks 725 may include a threaded block 735. The threaded block 735, as depicted, includes a threaded end configured to selectively engage a threaded rod operated through a corresponding lumen (e.g., channels 705, 710) in response to operation of the control members 715, 720.

In some implementations, in operation, when the control member 715 is rotated and driven towards the channels 705, the spring coil 730 may be pressed towards the clamping block 725. For example, when a tension adjusting rod is received at the channel 705 and the control member 715 is rotated towards the channel, the tension adjusting rod may be secured at a desire position at the tension adjusting brace 700.

Figure 8:
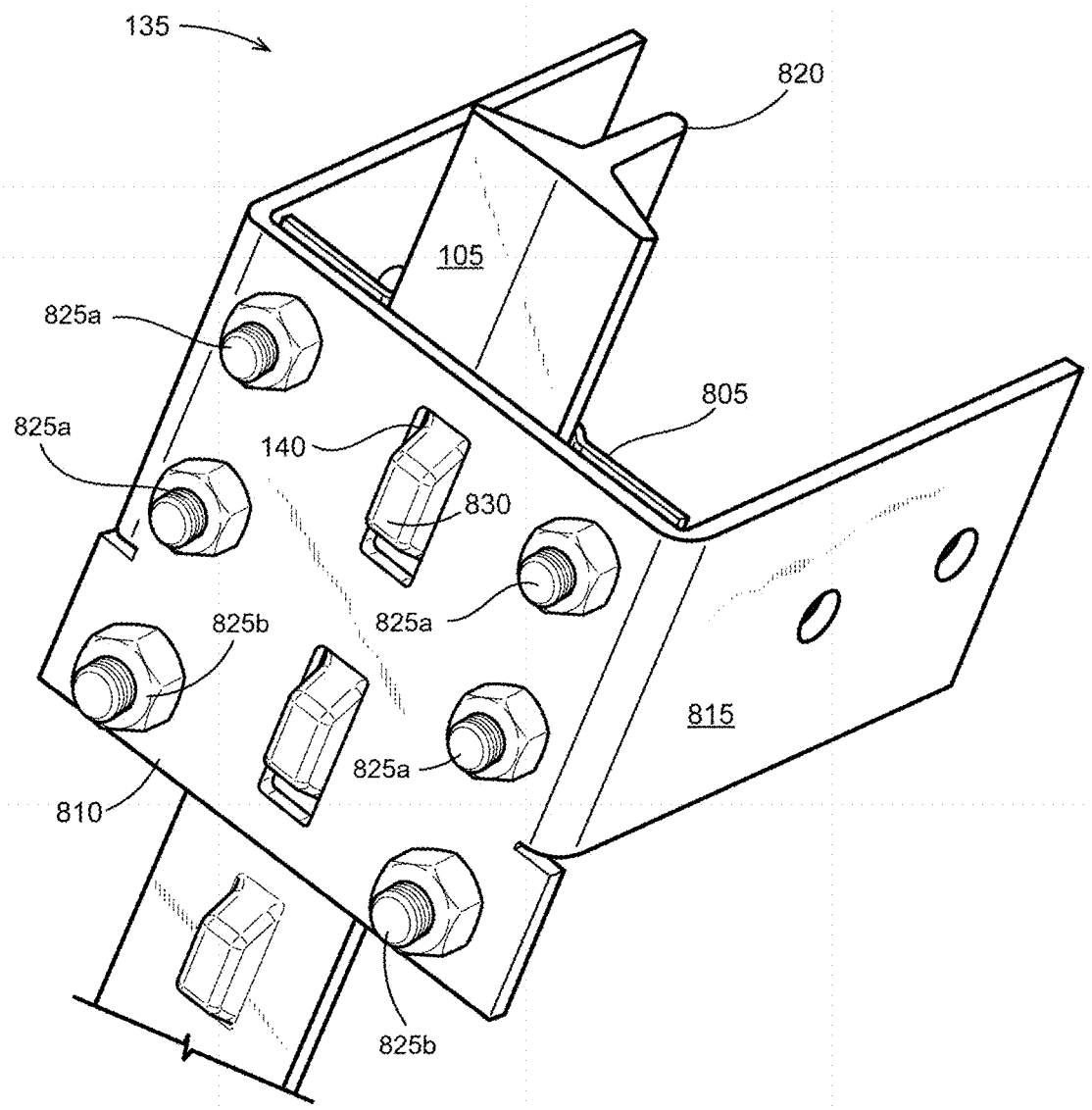
FIG. 8 depicts a perspective view of an exemplary adaptive fence brace (AFB) bracing a fence post.

FIG. 8 depicts a perspective view of an exemplary adaptive fence brace (AFB) 135 bracing a fence post 105. As shown, the AFB 135 includes a butterfly clamp 805 and a C-bracket 810. In this example, the butterfly clamp 805 is installed on the blade side of the fence post 105. The C-bracket 810 is installed on the opposite side, the stud side of the fence post 105. As shown, a corresponding side wall 815 of the C-bracket 810 extends from each side in the same direction as a blade 820 of the fence post 105 in this configuration. The body of the fence post 105 is, as shown in this example, sandwiched between the butterfly clamp 805 and the C-bracket 810.

In this example, the butterfly clamp 805 and the C-bracket 810 are fastened to each other and consequently to the fence post 105 using bolts 825*a*, 825*b* (e.g., 825*b* may have a larger diameter than 825*a*, such as corresponding to a diameter of the corresponding aperture). As shown, the fence post 105 includes studs 830 that protrude through the slots 140 when the AFB 135 is secure at the fence post 105.

Figure 9:
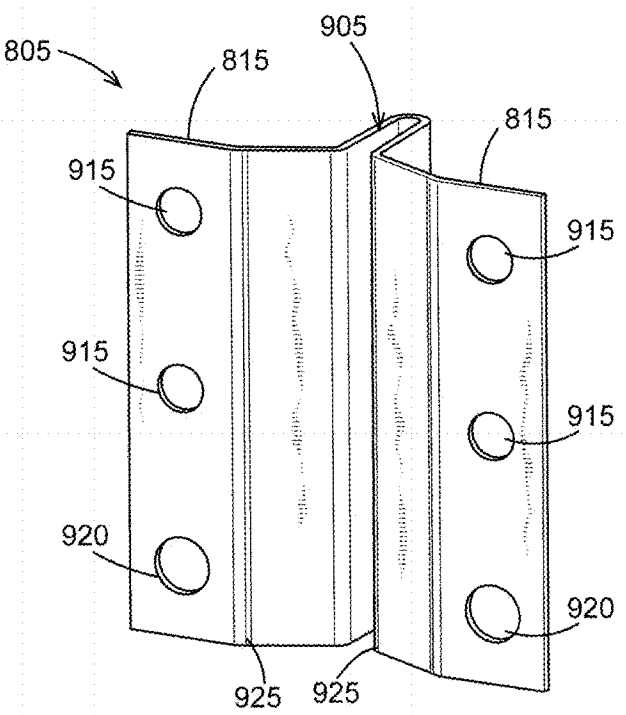
FIG. 9 depicts a perspective view of an exemplary butterfly clamp.

FIG. 9 depicts a perspective view of an exemplary butterfly clamp 805. In this example, the butterfly clamp 805 includes a rib receiving channel 905. For example, the rib receiving channel 905 may receive a ridge portion of a T-post along a longitudinal axis. From the rib receiving channel 905, the butterfly clamp 805 includes two side walls 815. In this example, the side walls 815 include two pairs of horizontally aligned first apertures 915. In some implementations, the first apertures 915 may be registered, in use, with a bracket to securely couple to a T-post. The side walls 815 further includes one pair of horizontally aligned second apertures 920, in this example. In some implementations, the second aperture 920 may be larger than the first aperture 915. For example, the second aperture 920 may be used to couple with the tension adjusting rod 155 and/or the coupling member 160.

In this example, the butterfly clamp 805 further includes an adaptive facing 925 between the rib receiving channel 905 and each of the side walls 815. In some implementations, the adaptive facing may provide room for adaptively coupling to fence posts of different sizes and thickness.

Figure 10:
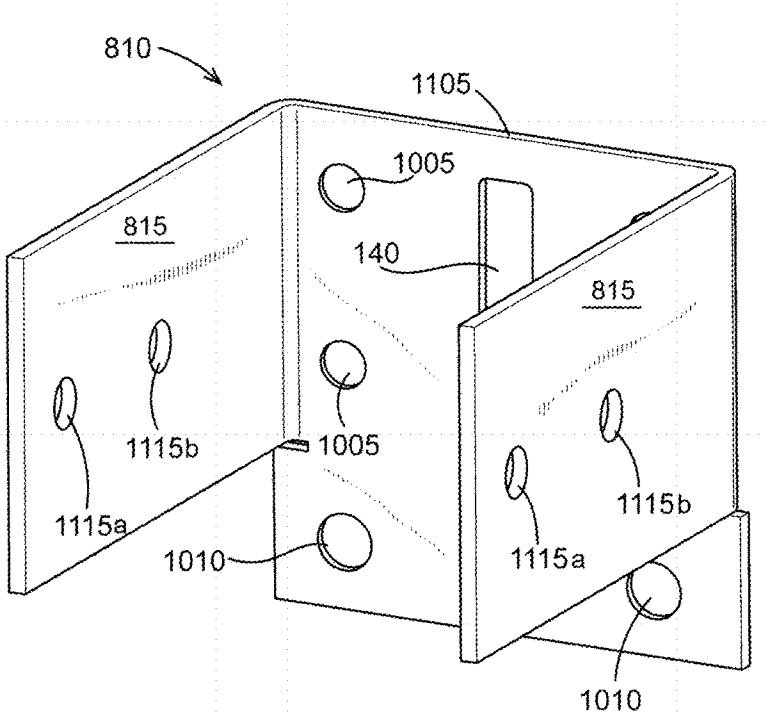
FIG. 10 depicts a perspective view of an exemplary C-bracket.

FIG. 10 depicts a perspective view of an exemplary C-bracket 810. The C-bracket 810 includes a back wall 1105. The back wall 1105 may, as shown in this example, engage a stud side of the fence post 105. In this example, the C-bracket 810 includes two slots 140 for receiving the studs 830 of the fence post 105. The C-bracket 810 also includes, in this example, first apertures 1005 and second apertures 1010 for registering with the butterfly clamp 805.

For example, studs of a T-post may protrude through the slots 140. The back wall 1105 includes two pair of horizontally aligned first apertures 1005. In some implementations, the first apertures 1005 may be registered to the first apertures 915 of the butterfly clamp 805. The back wall 1105 further includes one pair of horizontally aligned second apertures 1010, in this example. In some implementations, the second aperture 1010 may be larger than the first aperture 1005. For example, the second aperture 1010, together with the second aperture 920, may be used to securely couple with the tension adjusting rod 155 or the coupling member 160.

In the depicted example, the C-bracket 810 includes side walls 815 extending perpendicularly from the upper ⅔ of the back wall 1105. In some implementations, each of the side walls 815 may include horizontally disposed (two) sets of transversely opposed apertures 1115 for fastening devices. In various implementations, transversely opposed apertures 1115 may be used to couple the fence posts 105 to the fence rails 115.

In some implementations, the butterfly clamp 805 may also be coupled to a bracket that is a flat plate having features as described as the back wall 1105.

In some implementations, a combination of the apertures 920, the corresponding apertures 1010, and bolts 825*a*, 825*b* with accompanying nuts 1205*a*, 1205*b* may be dual purpose. For example, the combination may be used to fasten the tension adjusting rod 155 and the coupling member 160 to the AFB 135 in addition to reinforcing the corresponding brackets to the fence posts 105.

Figure 11:
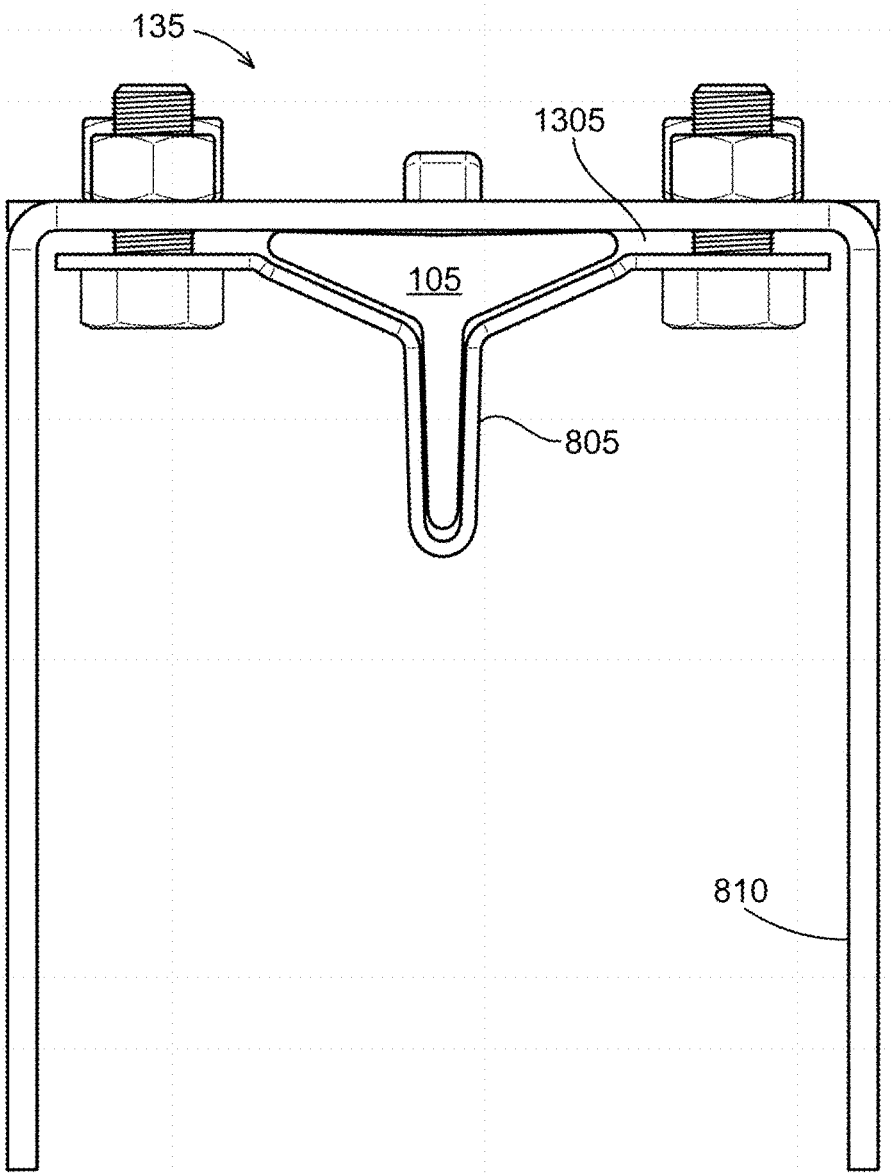
FIG. 11 shows a top view of an exemplary AFB.

FIG. 11 shows a top view of an exemplary AFB 135. As shown in this example, when the butterfly clamp 805 and the C-bracket are combined, the AFB 135 includes a pinch gap 1305 created by the adaptive facing 925 of the butterfly clamp 805. Accordingly, the AFB 135 may advantageously adapt to fence post 105 of various size and thickness.

Figure 12:
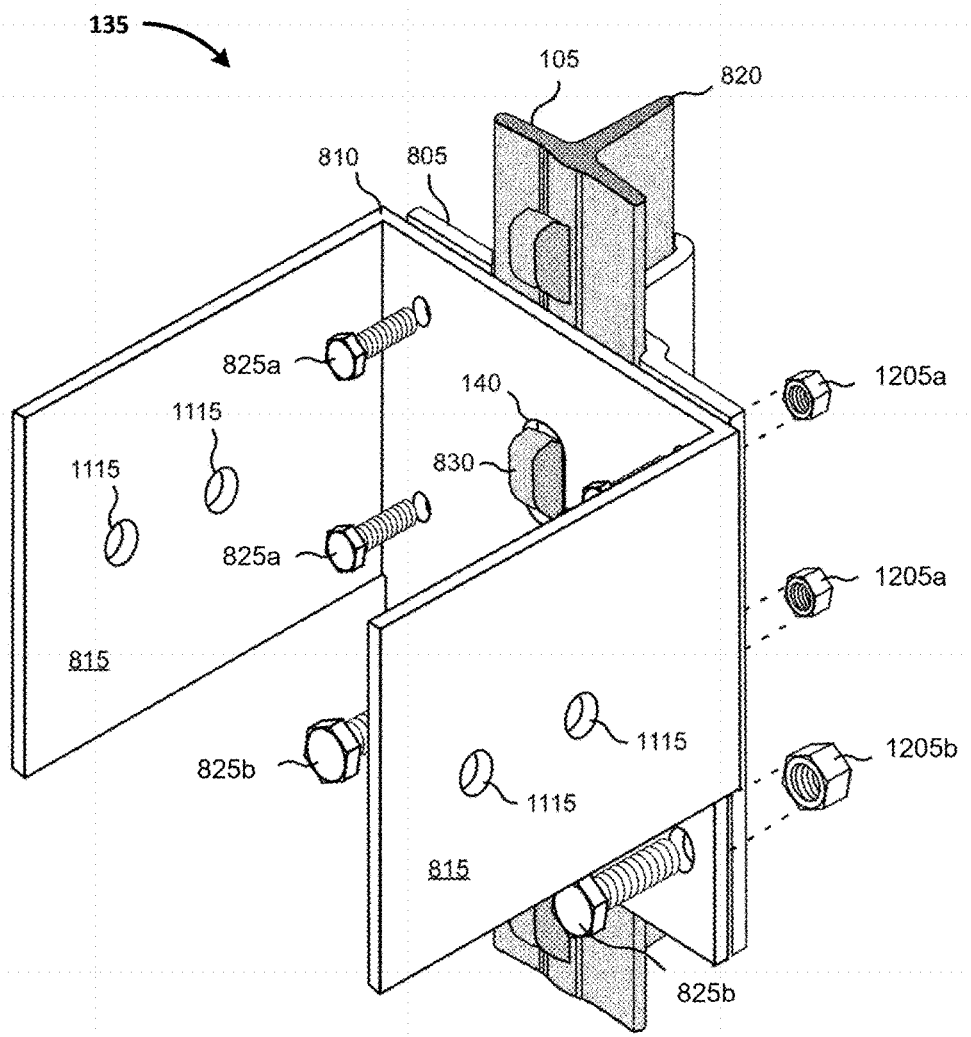
FIG. 12 shows a second exemplary arrangement of an exemplary AFB combining the butterfly clamp of FIG. 9, the C-bracket of FIG. 10, and the fence post.

FIG. 12 shows a second exemplary arrangement of an exemplary AFB 135 combining the butterfly clamp 805 of FIG. 9, the C-bracket 810 of FIG. 11, and the fence post 105. As shown, the butterfly clamp 805, the C-bracket 810, and the fence post 105 are fastened in a similar manner as described in FIG. 8. As shown, the C-bracket 810 is fastened to the butterfly clamp 805 with the bolts 825*a*, 825*b* and nuts 1205*a*, 1205*b*. In this example, the side walls 815 extends in the opposite direction as the blade 820.

Figure 13A:
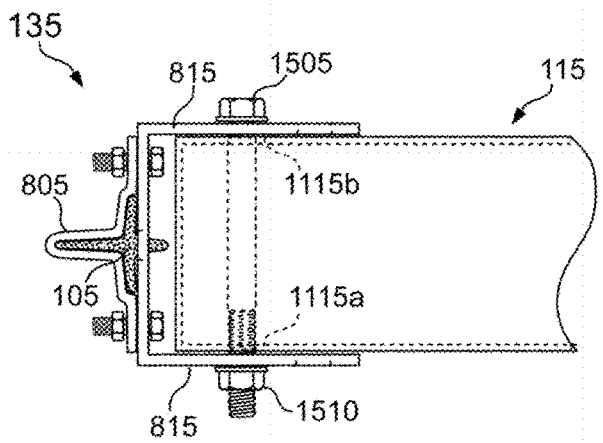
FIG. 13A, FIG. 13B, and FIG. 13C illustrate top plane views of exemplary AFB arrangements having one end of a fence rail 115 installed at various locations of the AFB.
Figure 13B:
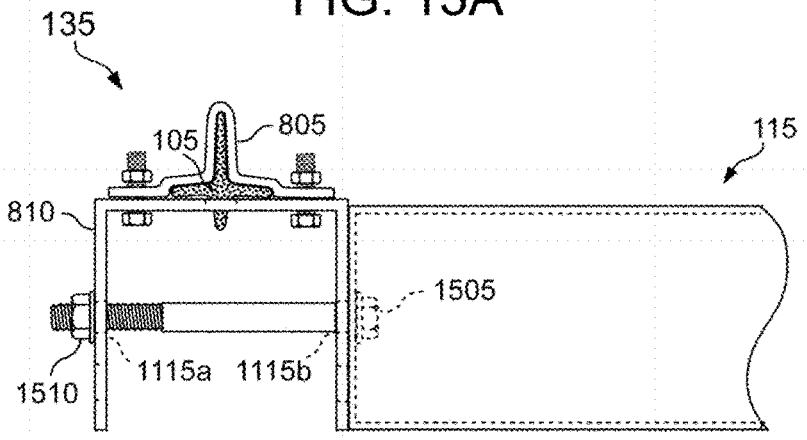
Figure 13C:
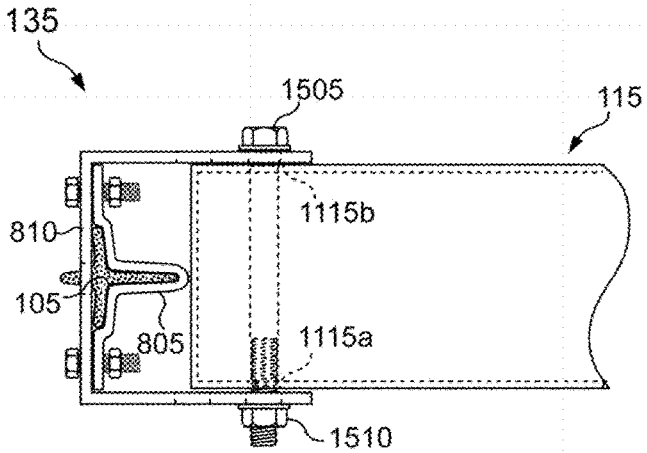

FIG. 13A, FIG. 13B, and FIG. 13C illustrate top plane views of an exemplary AFB 135 arrangements having one end of a fence rail 115 installed at various locations of the AFB 135. Referring to FIG. 13A, the fence rail 115 at one end is installed in between the side walls 815 of the C-bracket 810. As shown, a fastening bolt 1505 traverses through a pair of apertures 1115*a*, 1115*b* on the side walls 815, and through apertures of the fence rail 115. For example, the fastening bolt 1505 is secured with an internally threaded nut 1510 threaded over the externally threaded segment of the fastening bolt 1505.

Referring to FIG. 13B, the fence rail 115 is installed on an outside of one of the side walls 815 of the C-bracket 810. In this example, the side walls 815 (e.g., sidearms) are on a stud side of the fence post 105. As shown, the fastening bolt 1505 traverses an aperture on the fence rail 115 and the apertures 1115 on the side walls 815. For example, the fastening bolt 1505 is secured with an internally threaded nut 1510 threaded over an externally threaded segment of the fastening bolt 1505.

Referring to FIG. 13C, the fence rail 115 is installed in between the side walls 815. As shown in this example, the side walls 815 are on the blade side of the fence post 105. In this case, the fastening bolt 1505 may, for example, traverses an outer set of the apertures 1115 of the side walls 815.

Figure 14A:
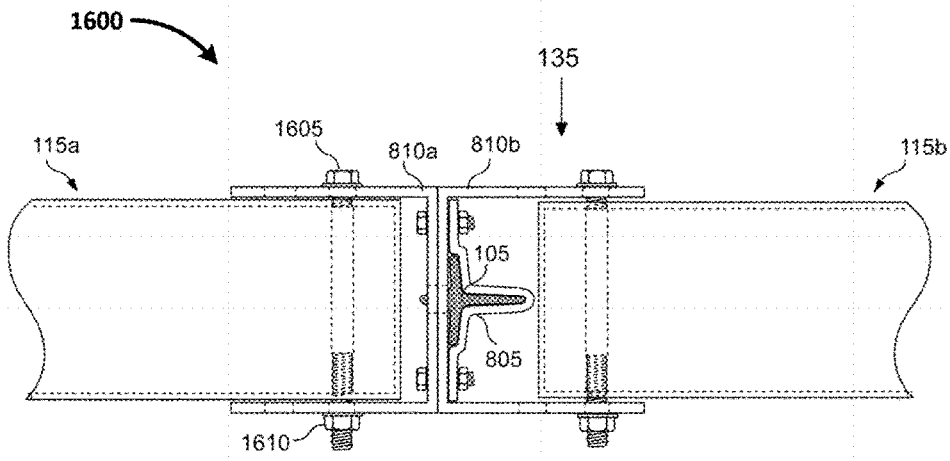
FIG. 14A, FIG. 14B, FIG. 14C, and FIG. 14D show top plane views of exemplary AFBs that couple two fence rails.

FIG. 14A, FIG. 14B, FIG. 14C, and FIG. 14D show top plane views of exemplary AFBs 135 that couple two fence rails 115. Referring to FIG. 14A, the AFB 135 is coupled to another C-bracket 810*b*, creating an extended AFB 1600 having a combination of C-brackets 810*a*, 810*b*. In some examples, either side of the AFB 1600 may have side walls 815 available for fastening the fence rails 115. As shown in this example, a first fence rail 115*a* is fastened at the C-bracket 810*a*, and a second fence rail 115*b* is fastened at the C-bracket 810*b*.

Figure 14B:
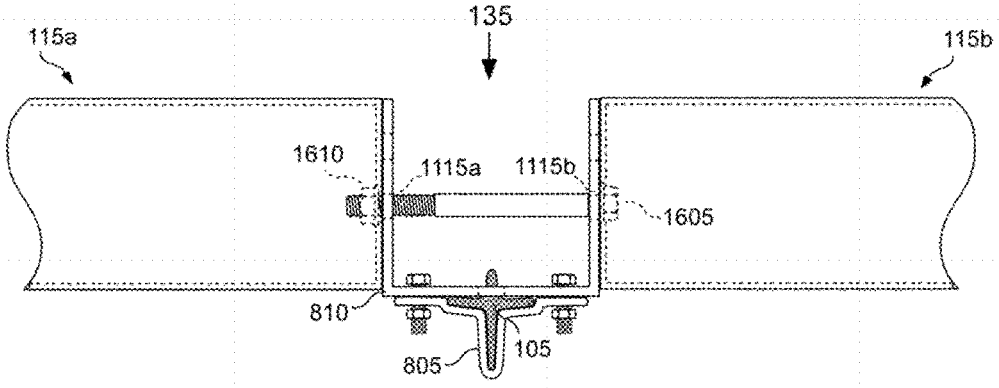
Figure 14C:
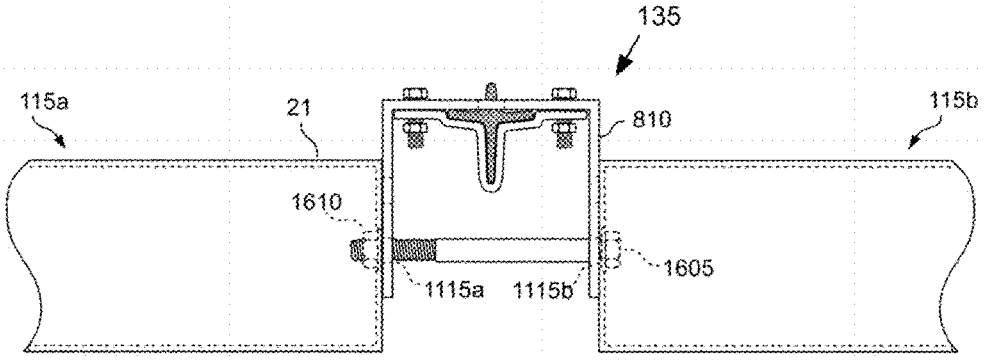

Referring to FIG. 14B, the fence rails 115*a*, 115*b* are installed on the outside of the side walls 815 of the AFB 135. A fastening bolt 1605, in this example, traverses the fence rail 115*a*, the inner set of the apertures 1115, and the fence rail 115*b*. In this example, the fastening bolt 1605 is secured with a nut 1610. A similar installation of fence rails on the AFB 135 is shown in FIG. 14C. The fence rails 115*a*, 115*b*, as shown in the example shown in FIG. 14C, are installed on the outside of the side walls 815 of the AFB 135. A fastening bolt 1605, in this example, traverses the fence rail 115*a*, the outer set of the apertures 1115, and the fence rail 115*b*. In this example, the fastening bolt 1605 is secured with a nut 1610.

Figure 14D:
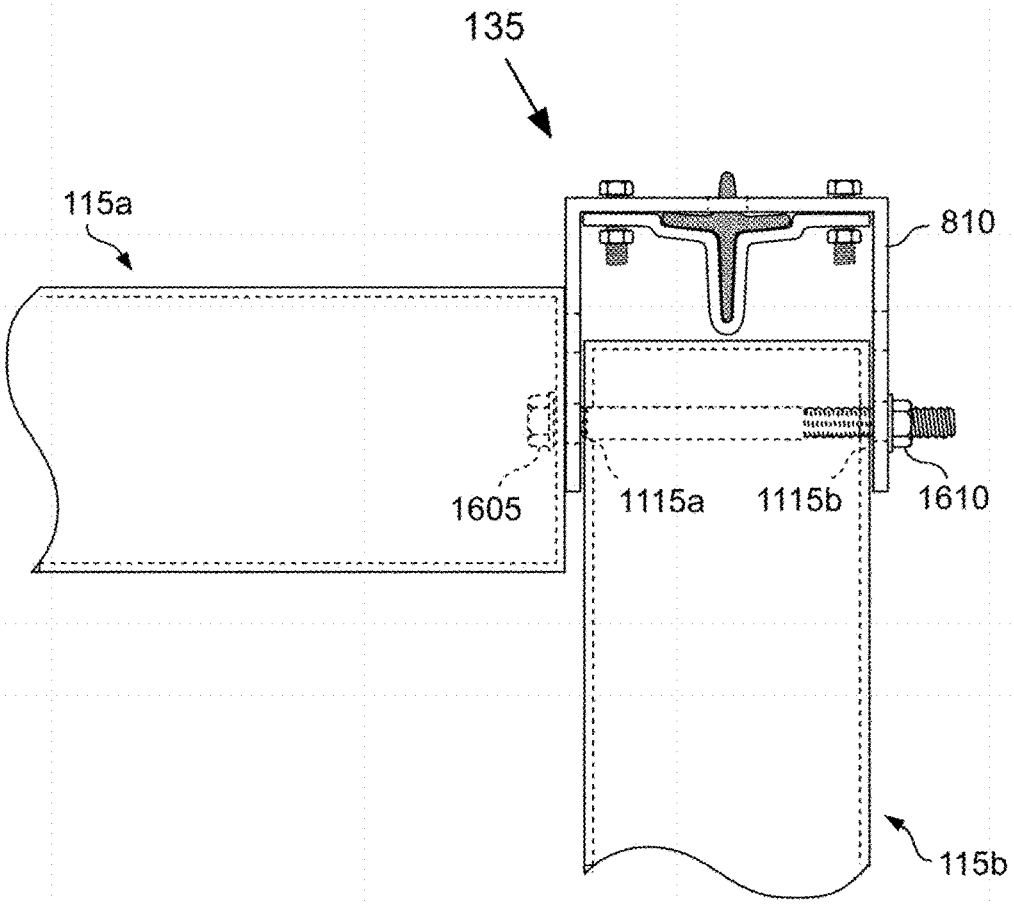

To brace corners and T-junctions of fences, the fence rails 115, in some implementations, may be installed perpendicular to each other. As shown in FIG. 14D, the AFB 135 is installed on a corner fence post. The fence rail 115*a*, for example, may be fastened on the outside of the side walls 815. The fence rail 115*b* may be fastened in between the sidearms, for example. A fastening bolt 1605 may, in some implementations, traverse an end of the fence rail 115*a*, the aperture 1115*a*, a side of the fence rail 115*b*, and the aperture 1115*b*. The fastening bolt 1605 may be secured with the nut 1610, for example.

Figure 15A:
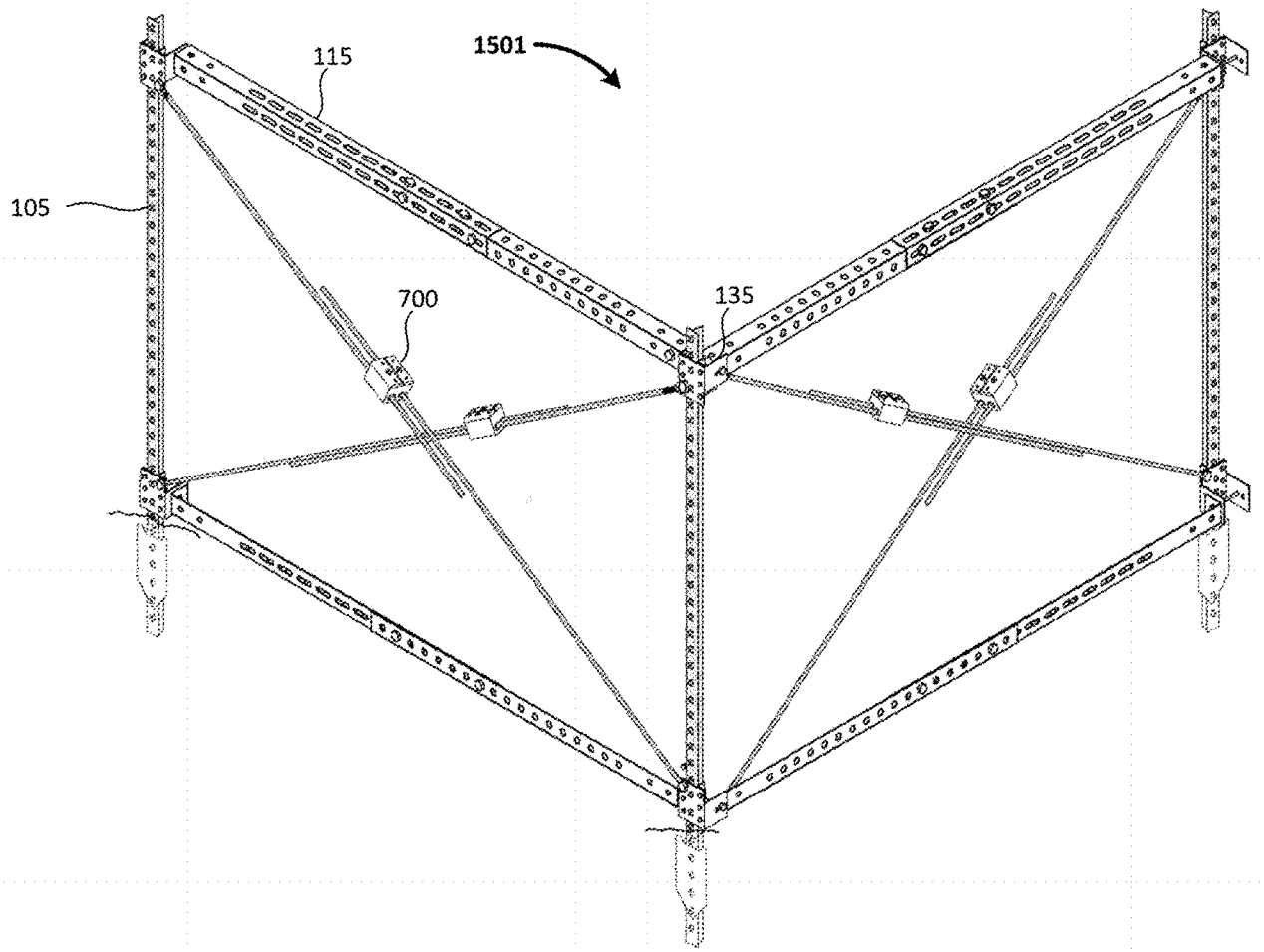
FIG. 15A, FIG. 15B, and FIG. 15C depict exemplary applications of ERFBS with wood posts, T-posts, and a combination thereof.
Figure 15B:
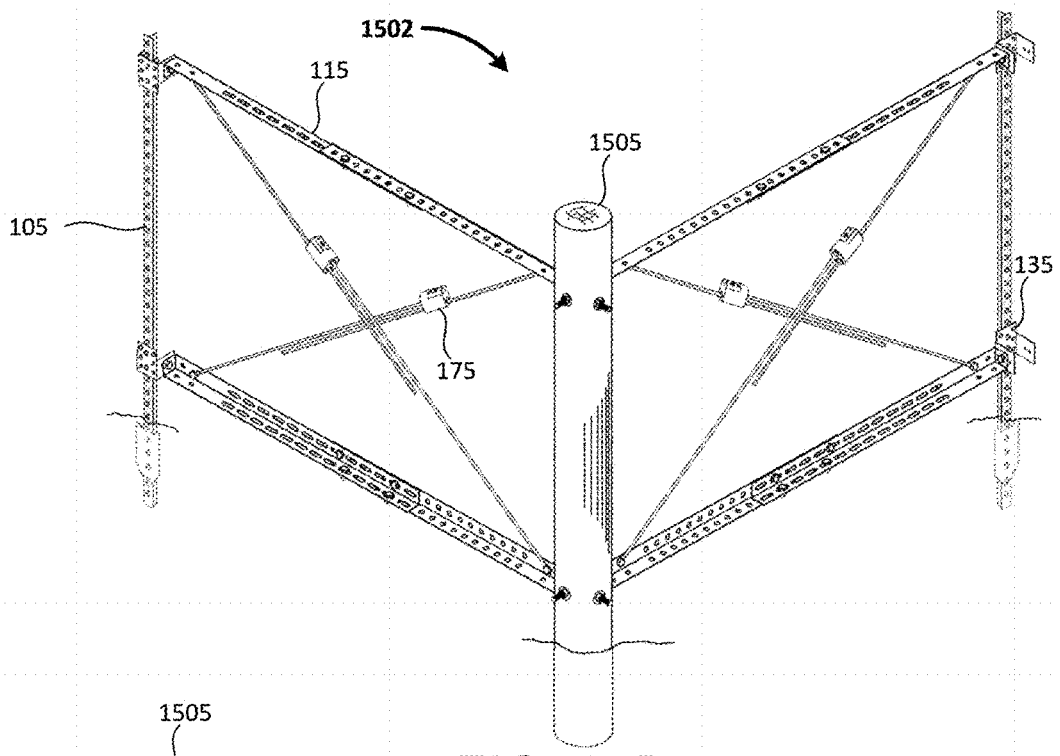
Figure 15C:
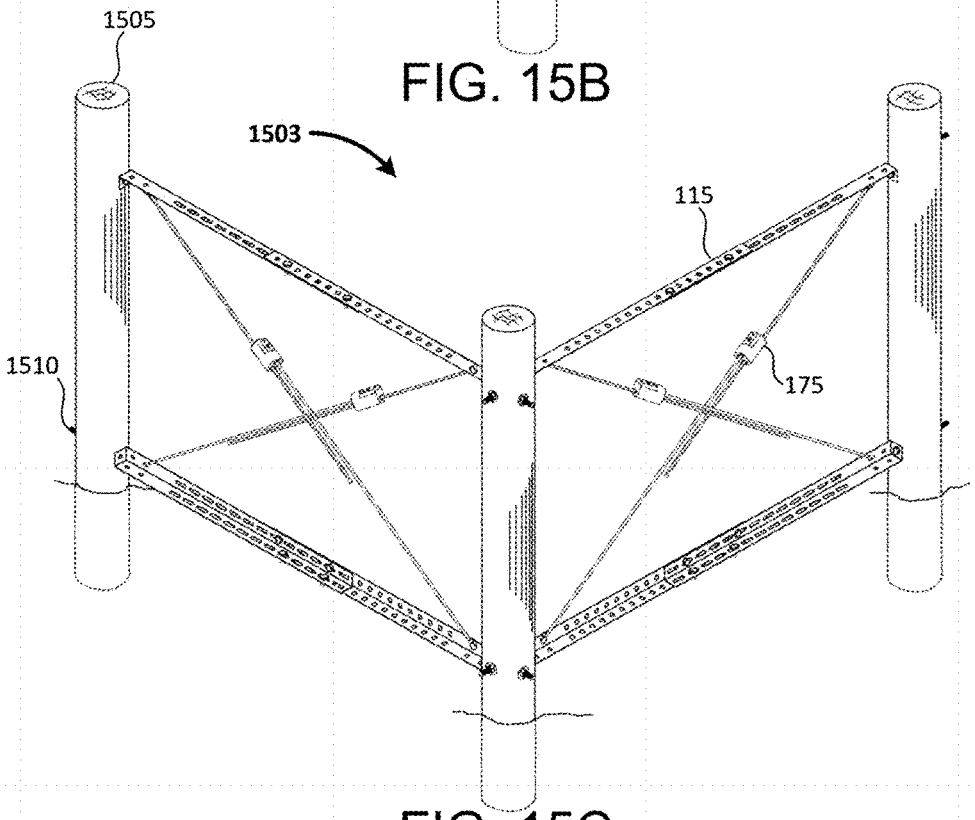

FIG. 15A, FIG. 15B, and FIG. 15C shows exemplary applications of ERFBS 100 with wood posts, T-posts, and a combination thereof. For example, FIG. 15A depicts a corner fence brace 1701 constructed using fence post 105 (t-posts, as depicted). In various implementations, adjacent fence posts 105 may be diagonally braced by either one or two tension adjusting rods. As shown in FIGS. 15B-15C, a brace may be constructed at least partially using a wood post 1705. For example, corner fence brace 1702 depicts a corner wood post 1705 coupled to two t-posts (fence post 105). Corner fence brace 1703 depicts three wood posts 1705.

As depicted, a tension adjusting rod may be coupled to the wood post 1705 (e.g., instead of using the AFB 135), via a coupling feature of the fence rail 115. For example, a coupling member 1710 may be embedded in the wood post 1705. The coupling member 1710 may, for example, be a bolt fastened through a hole drilled in the wood post 1705. In some embodiments, an end of the tension adjusting rod (e.g., coupled to the brace 175 and/or the brace 700) may be directly coupled to the coupling member 1710 (e.g., instead of being coupled to the fence rail 115).

In some examples (not shown), an AFB 135 may be coupled to the wood post 1705 (e.g., through first apertures 1005 and/or second apertures 1010). The fence rail 115 and/or a tension module (e.g., brace 175, brace 700) may be coupled to the wood post 1705 via the AFB 135.

Figure 16A:
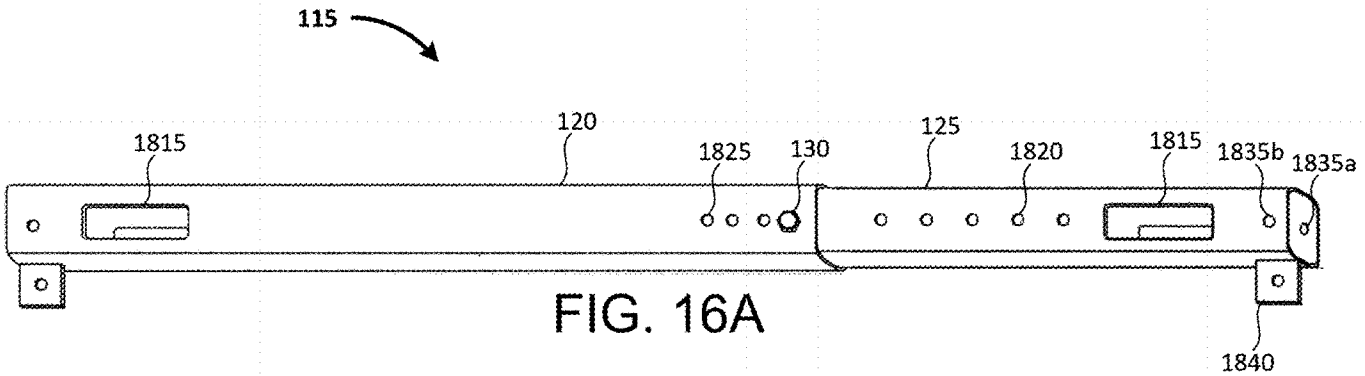
FIG. 16A and FIG. 16B depict exemplary bracing rails.
Figure 16B:
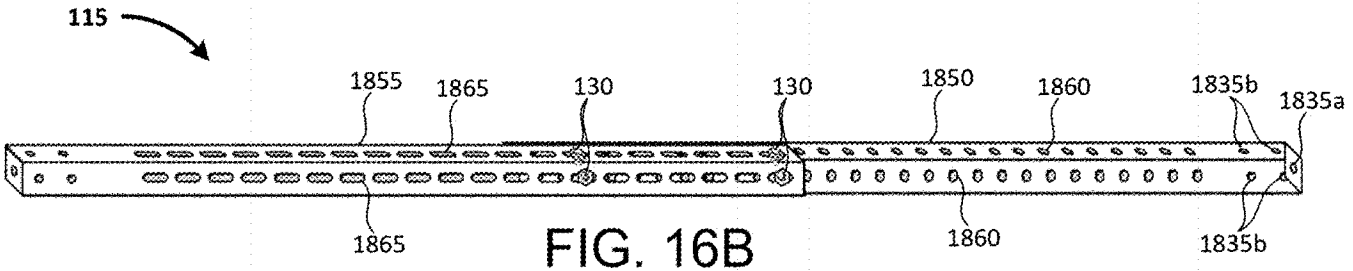

FIG. 16A and FIG. 16B depict exemplary bracing rails. As depicted in FIG. 16A, the fence rail 115 is assembled from an inner rail 125 and an outer rail 120. In the depicted example, the inner rail 125 and the outer rail 120 each have a substantially rectangular cross-section (e.g., a square cross-section, as depicted). The inner rail 125 is configured to be slidingly received within the outer rail 120. The inner rail 125 is provided with a first set of apertures 1820 distributed along the longitudinal axis of the inner rail 125. The outer rail 120 is provided with a second set of apertures 1825 distributed along the longitudinal axis of the outer rail 120. When the longitudinal axes of the inner rail 125 and the outer rail 120 are aligned and the inner rail 125 and the outer rail 120 are slid together to a desired length such that at least one of the first set of apertures 1820 is aligned with a at least one of the second set of apertures 1825, a coupling member 130 (e.g., a bolt and nut, a pin) may be coupled through the corresponding apertures to fix the fence rail 115 at a desired length.

In the depicted example, the inner rail 125 and the outer rail 120 each are provided with an aperture 1835*a* at a distal end. For example, the aperture 1835*a* may be used to fasten the distal end of the rail to a post (e.g., directly, by a bolt, to an AFB 135). An aperture 1815 may, for example, be configured to provide access into an interior of the rail to reach an inner side of the distal end (e.g., to reach the inside of the aperture 1835*a*). The aperture 1815 may, for example, advantageously provide access to fasten a bolt, nut, and/or other coupling member.

In the depicted example, the inner rail 125 and the outer rail 120 are each provided with at least one aperture 1835*b* just proximal of the distal end. For example, the at least one aperture 1835*b* may be used to couple the fence rail 115 to a host (e.g., a post, an AFB 135, an anchor in a wood post).

As depicted, the inner rail 125 and the outer rail 120 are each provided with a coupling member 1840 (e.g., a tab with a hole, as depicted) extending substantially orthogonally from the longitudinal axis. The coupling member 1840 may, for example, couplingly receive (e.g., by a bolt, a pin, a rivet) an end of a diagonal bracing rod (e.g., engagement end 220 of the FBGB 165, rod 155 and/or coupling member 160 of the brace 175 and/or brace 700.

As depicted in FIG. 16B, the fence rail 115 is assembled from a first rail 1850 and a second rail 1855. In the depicted example, the first rail 1850 is provided with a first set of apertures 1860. The second rail 1855 is provided with a second set of apertures 1865. In the depicted example, the apertures 1865 each extend (e.g., as slots) in a first direction substantially parallel to a longitudinal axis of the fence rail 115. The apertures 1860 each extend (e.g., as slots) in a second direction substantially orthogonal to the longitudinal axis of the fence rail 115. When the first rail 1850 and the second rail 1855 are brought into alignment such that their corresponding longitudinal axes are substantially aligned, the first rail 1850 and the second rail 1855 may be coupled together by at least one coupling member 130 being coupled through corresponding apertures of the first set of apertures 1860 and the second set of apertures 1865. As depicted, by the apertures 1860 and the apertures 1865 extending in different direction (e.g., substantially orthogonal to each other, as depicted), a user may easily align the apertures to insert the at least one coupling member 130 through them. The slots may, for example, advantageously enable the apertures to be aligned regardless of offset in the holes due to a thickness of the first rail 1850 and the second rail 1855. For example, the slots may allow the first rail 1850 and the second rail 1855 to be interchangeably used as an inner or outer rail (e.g., nested inside each other with either one being able to be nested inside the other and/or sitting over the other).

Although various implementations have been described with reference to the figures, other implementations are possible. In some implementations, the FBGB 165 may include various gearing ratio. For example, the ring gear 305 and the pinion gear 310 may have a 1:1-3:1 ratio. In some implementations, a worm gear may be used at the FBGB 165. The worm gear may, for example, be a reducing gear. In some implementations, the FBGB 165 may include a self-braking system. For example, when the tension at the tension adjusting rod 155 is above a threshold, the FBGB 165 may automatically stop length adjustment of the tension adjusting rod. For example, the self-braking system may avoid over tension of at the FBGB and protect the fence from damage. In some implementations, a reducing worm gear (e.g., driving the ring gear 305, such as in place of the pinion gear 310) may be configured as the self-braking (e.g., self-locking) system. For example, the worm gear may prevent rotation of the ring gear 305 in response to tension applied to the threaded rod. Some such implementations may, for example, not have stop blocks.

In some implementations, torque transmission may be provided by the ring gear 305 and the pinion gear 310, such as depicted in the corresponding figures. In some examples, the ring gear 305 and/or a drive gear (e.g., the pinion gear 310) may be configured as a bevel gear. A gear may, for example, be implemented as a spur gear.

Some implementations (e.g., of the FBGB 165) may include a stop block(s). For example, the stop block may be configured as a self-braking mechanism. In some implementations, the stop block may be configured as a manually-activated braking mechanism. The stop block may, for example, clamp against a rotating member (e.g., a gear, the threaded rod) to prevent rotation of the threaded rod in response to tension. Some implementations may, for example, omit the stop block(s).

In some implementations, a clamping block (e.g., 605, 725) may be configured as a floating block. For example, the floating block may be positioned within a cavity in the corresponding body (e.g., 175, 700) that is larger in at least one dimension. The floating block may, therefore, have room to 'float' along at least one axis such that the block may align with a threaded rod (e.g., to matingly align threads when being operated into a threading or clamping mode from a sliding mode). Terminal pads (e.g., 615) may, for example, be provided within the cavity to provide a (predetermined) minimum friction, prevent 'rattling' and/or reduce 'slop' (e.g., when the block is clamped such as by 515, 715, and/or 720).

In some implementations, the pinion gear 310 may be driven by a hexagonal socket. For example, the pinion gear 310 may be operated by inserting an Allen wrench into the hexagonal socket.

Figure 17D:
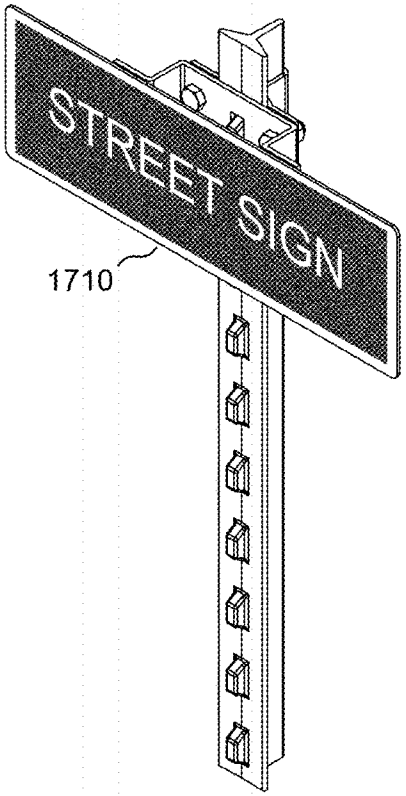
FIG. 17D shows an exemplary signage secured to an exemplary AFB with modified C-bracket-1 bracing a post.
Figure 17C:
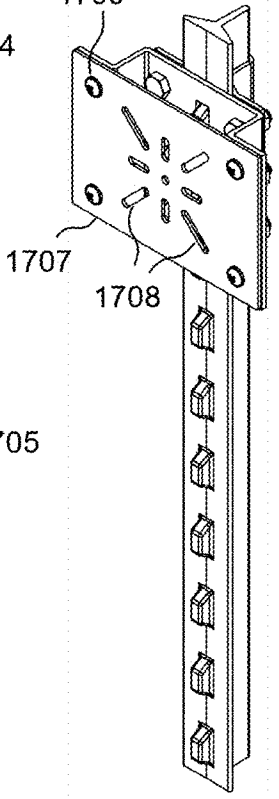
FIG. 17C shows a front plate with apertures for fasteners secured to an exemplary AFB with modified C-bracket-1 bracing a post.
Figure 17B:
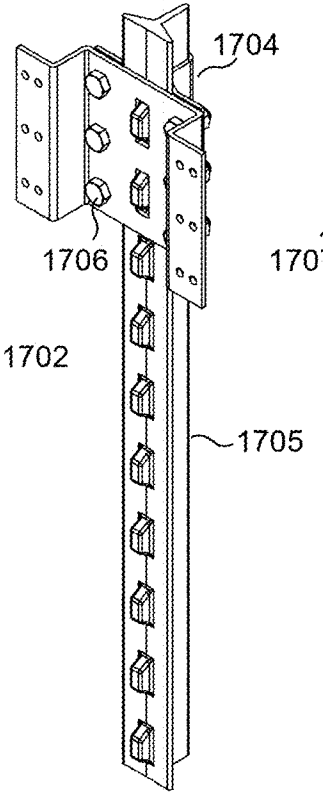
FIG. 17B shows an exemplary AFB with modified C-bracket-1 bracing a post.
Figure 17A:
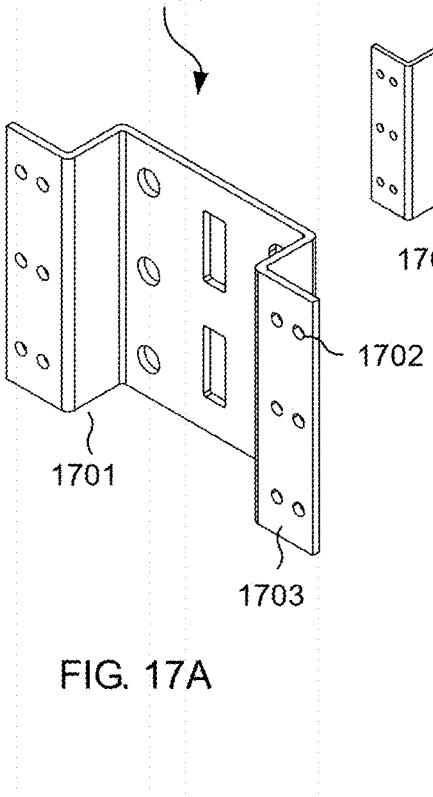
FIG. 17A Depicts a perspective view of an exemplary modified C-bracket-1 with L-shaped sidearms that have apertures for fasteners.

FIG. 17A depicts a modified C-bracket-1 1700 that comprises L-shaped sidearms 1701 that have one or more apertures 1702 on the front aspect 1703 for fasteners. In FIG. 17B, the modified C-bracket-1 is coupled with a butterfly clamp 1704 on the opposite side of a T-post 1705 and secured with fasteners 1706. The frontal aspect of the sidearms affords attachment of plates, sheets, or other objects. In FIG. 17C, a rectangular front plate 1707 with apertures arranged in a radial fashion, as an example 1708, is attached to the front of the T-post bracket with fasteners 1709 so that accessories of different sizes can be attached to the said plate. FIG. 17D shows a rectangular plate 1710 secured to the frontal aspect of the sidearms of the C-bracket-1 that can be used as a signage for a street, home address, security cameras, lights etc.

Figure 18C:
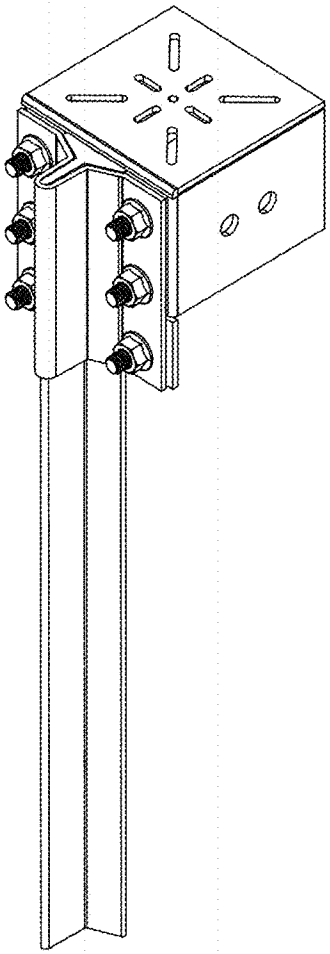
FIG. 18B and FIG. 18C show perspective views of an exemplary modified C-bracket-2 bracing a post.
Figure 18B:
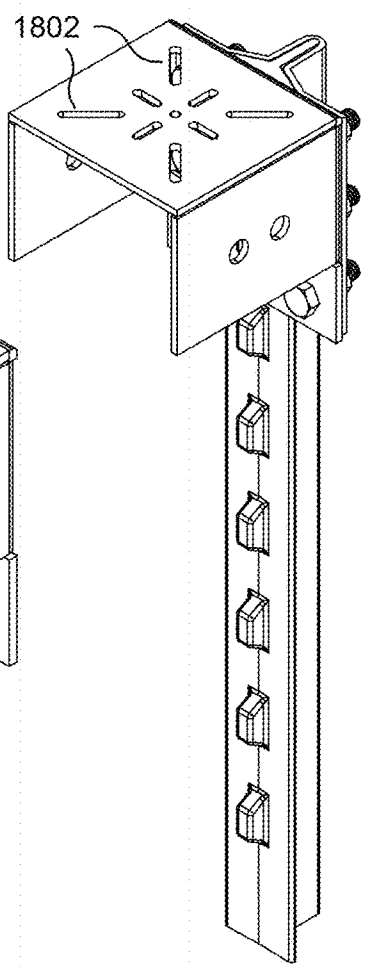
Figure 18A:
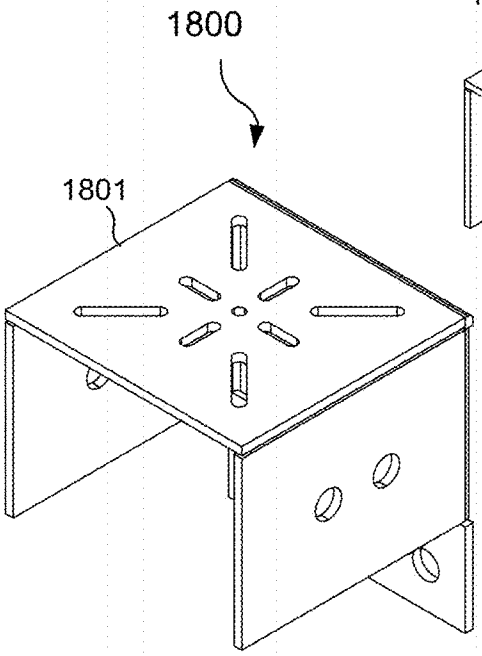
FIG. 18A depicts a perspective view of an exemplary modified C-bracket-2 with a rooftop plate having apertures for fasteners to attach accessories.

FIG. 18A depicts a modified C-bracket-2 1800 comprising a rooftop plate 1801 that has apertures for fasteners 1802 arranged in a radial fashion as an example. The modified C-bracket-2 1800 is coupled with a butterfly clamp on the opposite side of a T-post and secured with fasteners as shown in FIGS. 18B-18C. The rooftop plate is available for attachment of accessories such as security cameras, lights, solar panels etc.

FIG. 19A depicts a modified C-bracket-3A 1900 that has one sidearm trimmed and curved to a partial circle 1902 to hold an axle of a hinge. FIG. 19B depicts a similarly modified C-bracket-3B 1901 that has one sidearm trimmed and curved to a partial circle 1903 to hold an axle of a hinge. A complimentary pair of these modified C-brackets 3A and 3B is secured to a T-post by coupling with butterfly clamps on the opposite sides of the T-post allows to engage the hinges 1904, for example, of a door frame 1905.

Figures 20A, 20B, 20C, 20D:
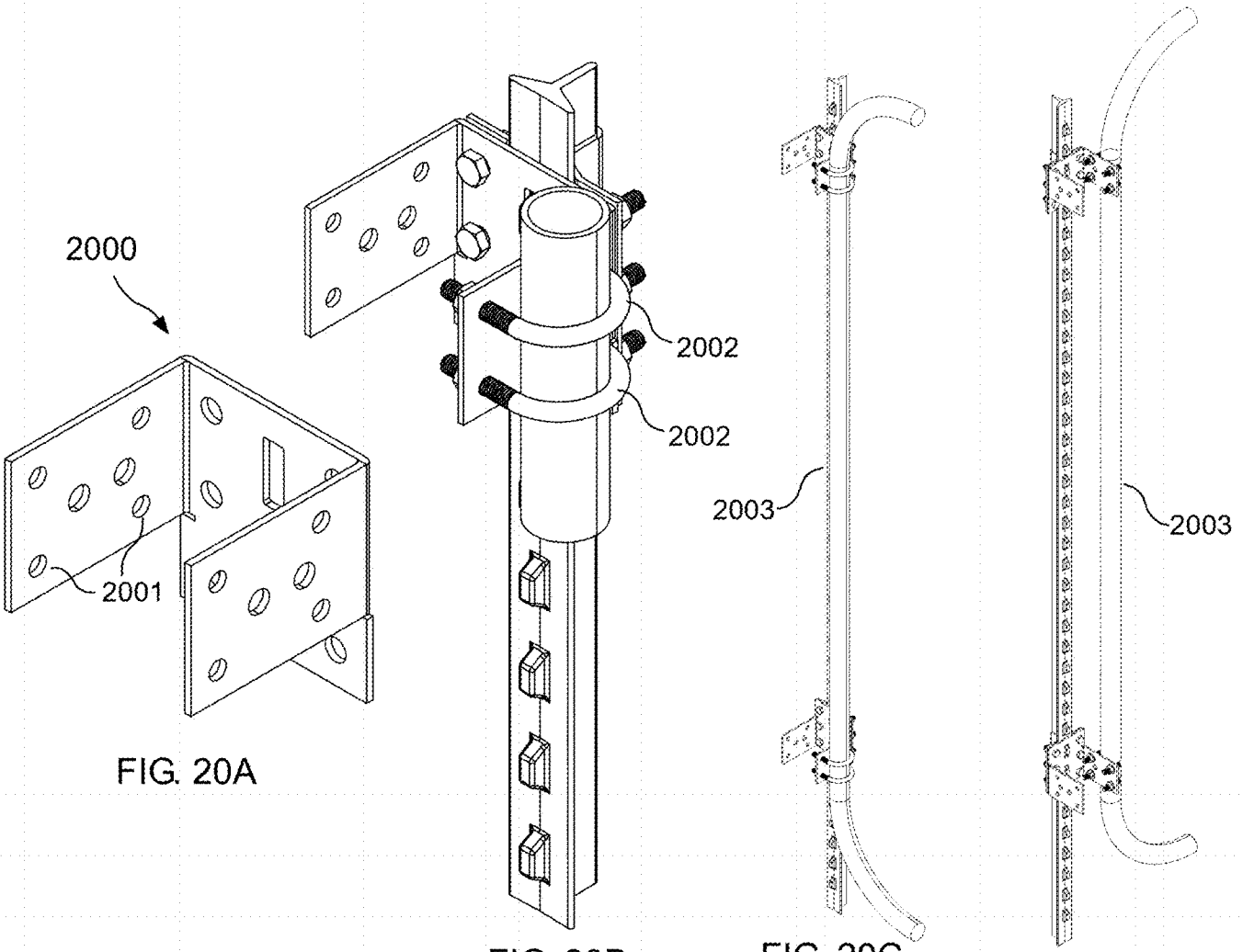
FIG. 20A depicts a perspective view of an exemplary modified C-bracket-4 with additional apertures in the sidearms to receive U-bolts.
FIG. 20B shows a perspective view of a pipe held in place by a pair of U-bolts fastened to the sidearm of the modified C-bracket-4.
FIG. 20C and FIG. 20D show the shaft of a pipe (for example a round door jamb) fastened by U-bolts to the sidearms of a pair of modified C-brackets-4.

To attach a tubular structure such as a pipe to a T-post, the modified C-bracket-4 2000 shown in FIG. 20A has pairs of apertures 2001 on the sidearms along the horizontal axis for the threaded U-bolts 2002 as shown in FIG. 20B. A tubular structure 2003, for example a tubular door jamb, is fastened to the sidearms of a pair of the modified C-brackets-4 2000 bracing the post at the upper and lower ends of the post as shown in FIGS. 20C and 20D. The modified C-bracket-4 2000 with sidearm having additional apertures 2001 can be used to attach items other than the ones requiring U-bolts.

Figure 21C:
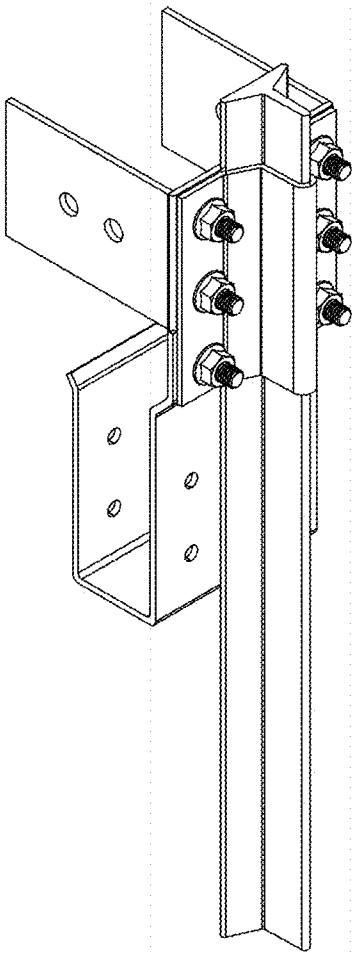
FIG. 21B and FIG. 21C show perspective views of exemplary modified C-bracket-5 bracing a post.
Figure 21B:
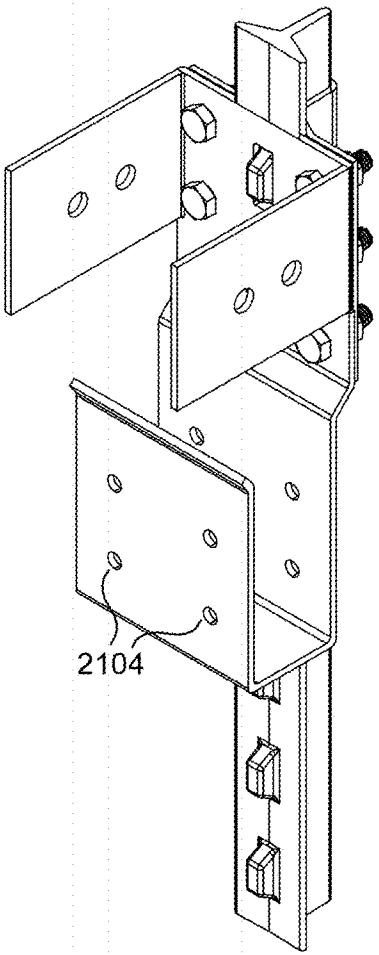
Figure 21A:
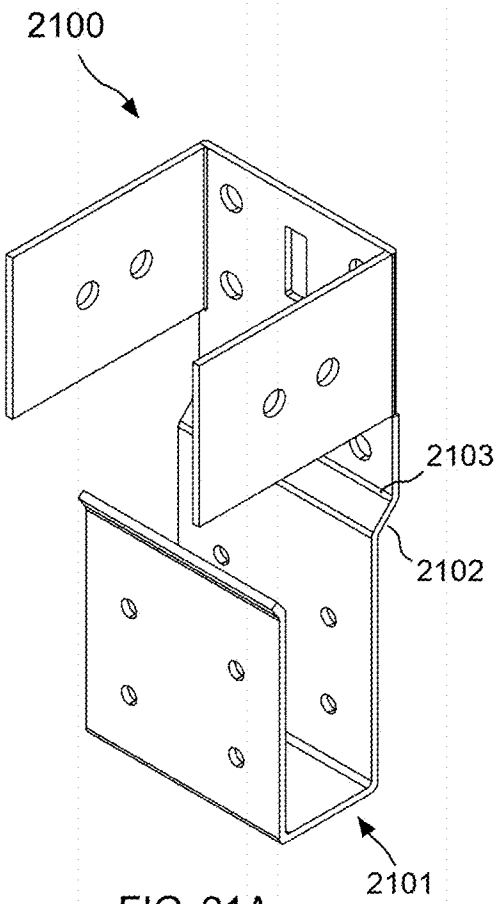
FIG. 21A depicts a perspective view of an exemplary modified C-bracket-5 with a U-shaped extension from a horizontal edge to hold wood plank or other block of material.
Figure 21D:
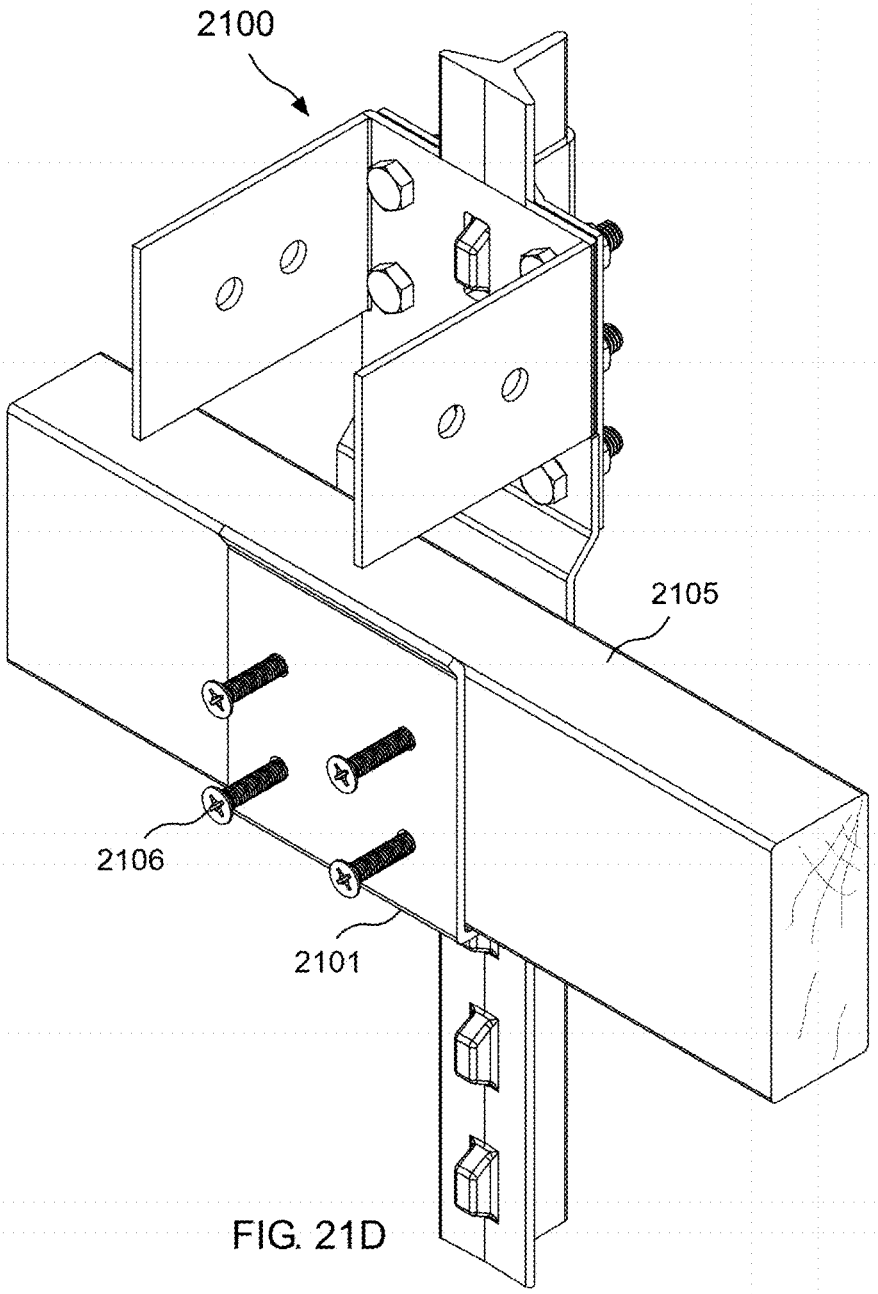
FIG. 21D show perspective view of an exemplary modified C-bracket-5 holding a wood plank (e.g., a 2×4) in the U-shaped extension.

For attachment of wood planks or similar block materials, the modified C-bracket-5 2100 shown in FIG. 21A comprises a U-shaped extension 2101 extending from the lower edge of an offset 2102 extending at an angle from the lower edge 2103 of the said C-bracket. The U-shaped extension 2101 has apertures 2104 to secure the plank with fasteners. FIGS. 21B and 21C depict a modified C-bracket-5 2100 bracing a post coupled with a butterfly clamp on the opposite side of the post. FIG. 21D depicts an exemplary implementation in which a wood plank 2105 is inserted in the U-shaped extension 2102 of the C-bracket-5 2100 and secured with fasteners 2106. The dimensions of the U-shaped extension 2101 are modular and for example can be made to accommodate planks of different sizes, 2×4, 2×6, 2×8 etc.

Figure 22C:
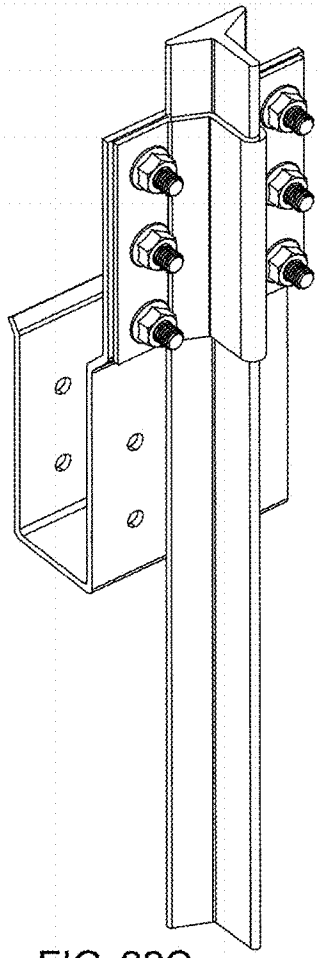
FIGS. 22B and 22C show perspective views of exemplary modified C-bracket-6 bracing a post.
Figure 22B:
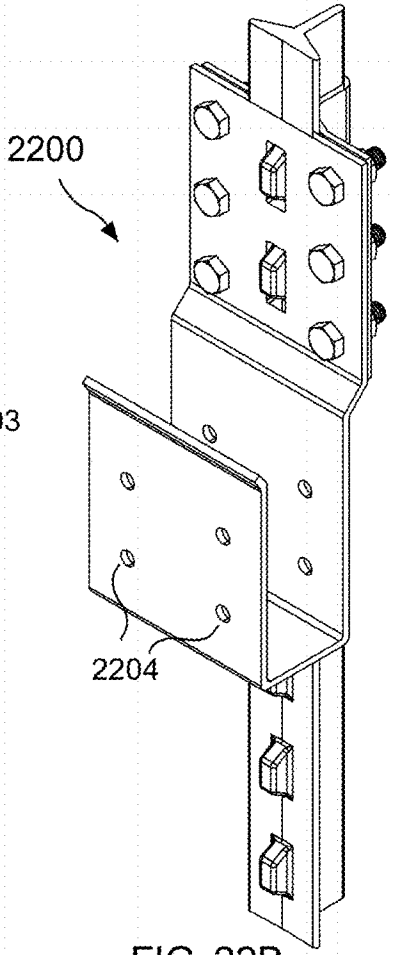
Figure 22A:
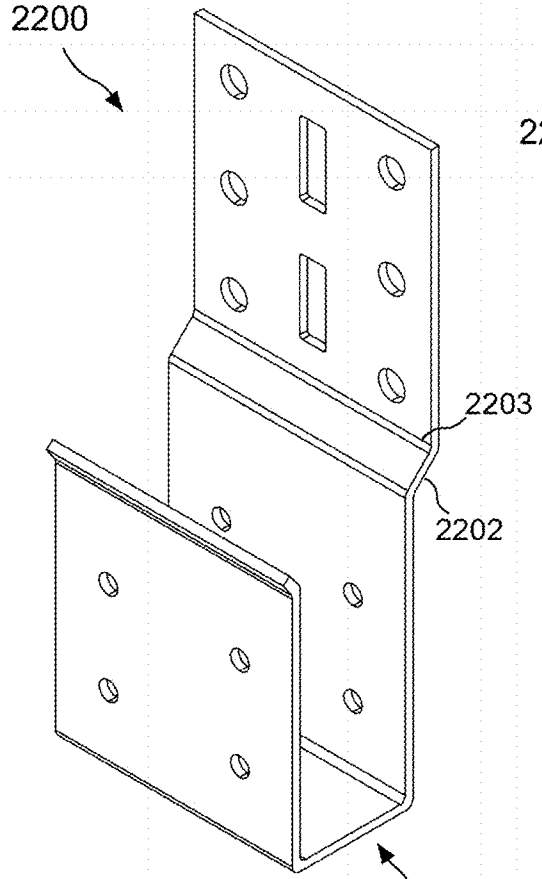
FIG. 22A depicts a perspective view of an exemplary modified C-bracket-6 without the sidearms and with a U-shaped extension from a horizontal edge to hold a wood plank or other block of material.
Figure 22E:
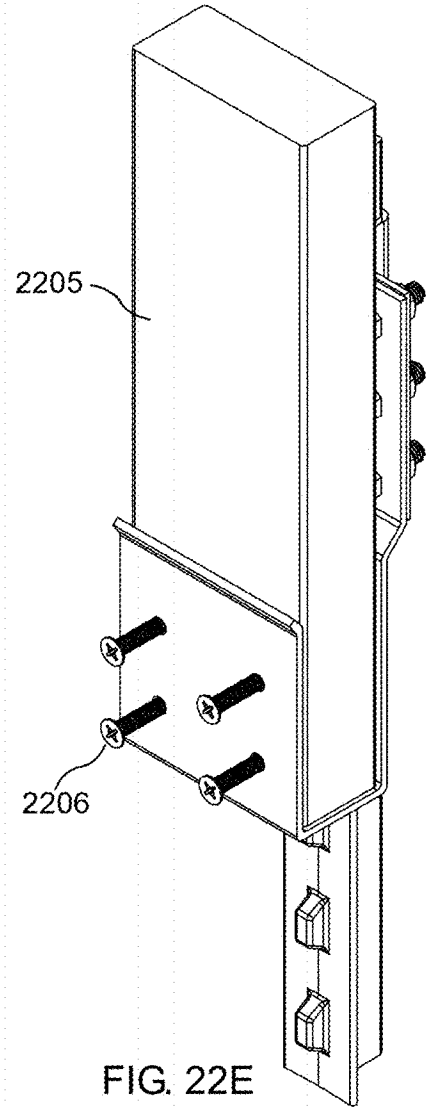
FIG. 22E shows a perspective view of exemplary modified C-bracket-6 holding a wood plank (e.g., a 2×4) in vertical position.
Figure 22D:
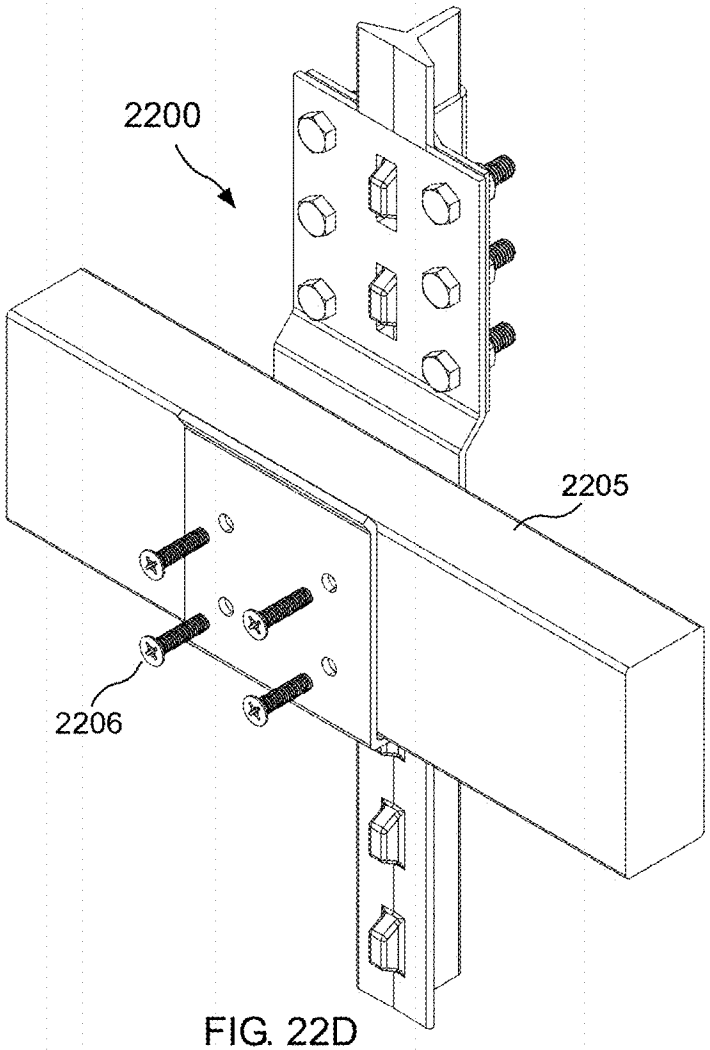
FIG. 22D shows a perspective view of exemplary modified C-bracket-6 holding a wood plank (e.g., a 2×4) in horizontal position.

FIG. 22A depicts a modified C-bracket-6 2200 without the sidearms and comprising a U-shaped extension 2201 extending from the lower edge of an offset 2202 extending at an angle from the lower edge 2204 of the said C-bracket. FIGS. 22B and 22C depict a modified C-bracket-6 2200 bracing a post coupled with a butterfly clamp on the opposite side of the post. FIG. 22D depicts an exemplary implementation in which a wood plank 2205 is inserted horizontally in the U-shaped extension of the C-bracket-6 2200 and secured with fasteners 2206. A plank 2205 can be inserted vertically in the U-shaped extension as shown in FIG. 22E. The dimensions of the U-shaped extension 2201 are modular and for example can be made to accommodate planks of different sizes, 2×4, 2×6, 2×8 etc.

Figures 23A, 23B, 23C:
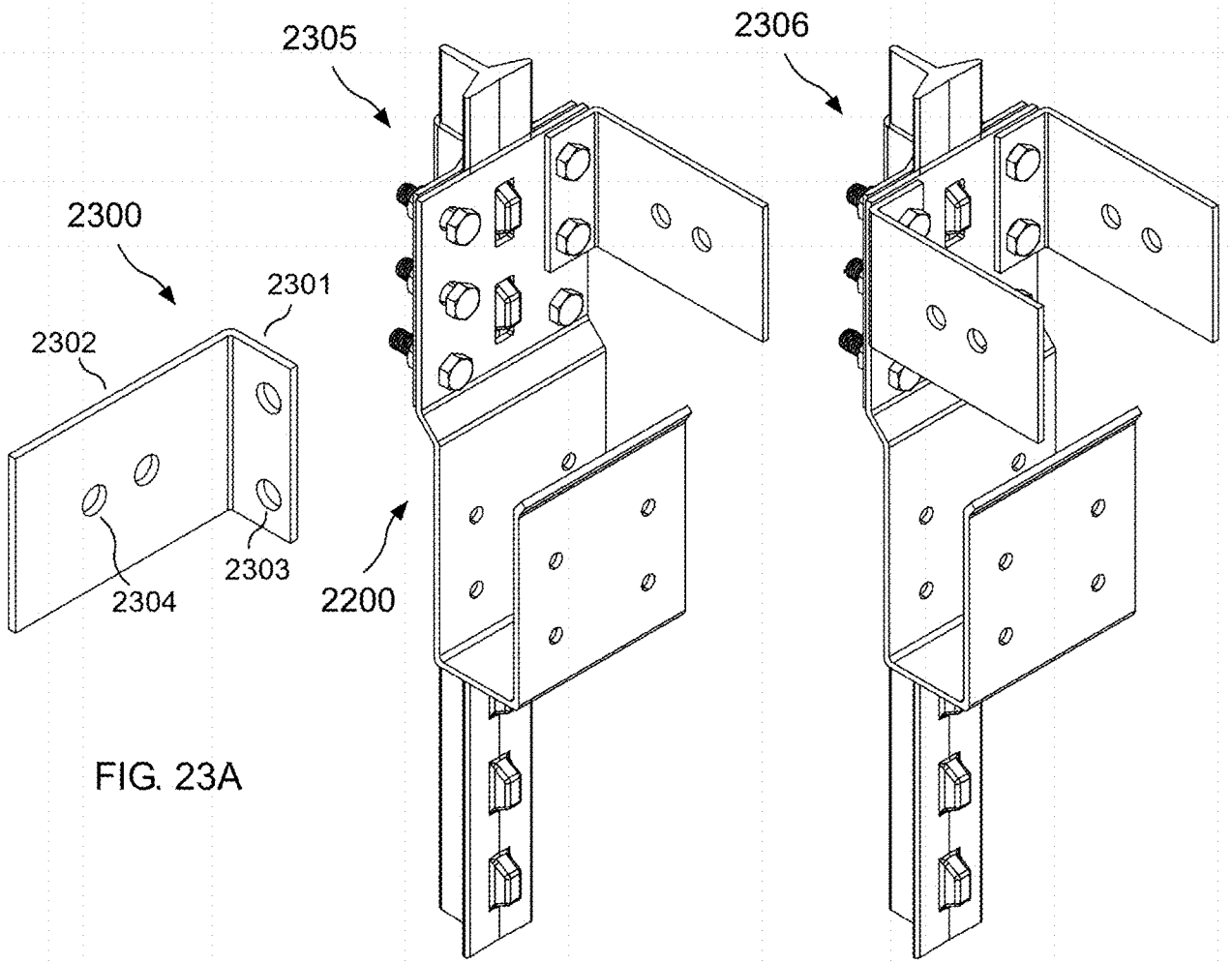
FIG. 23A depicts an L shaped symmetric piece that can be optionally attached to the modified C-bracket-6 for fastening fence rails on one side FIG. 23B or both sides FIG. 23C.

FIG. 23A depicts an L-shaped piece 2300 that has a short base plate 2301 that attaches to the C-bracket-6 2200 and a sidearm 2302 that extends at a perpendicular angle to the short base plate 2302. The short base plate 2301 has vertically arranged apertures 2303 to attach to the C-bracket-6 with fasteners and the side arm 2302 has horizontally arranged apertures 2304 to secure the fence rails. FIG. 23B shows the L-shaped piece applied to one sidearm 2305 or both sidearms 2306 of the C-bracket-6 2200 to support fence rails.

Figure 24B:
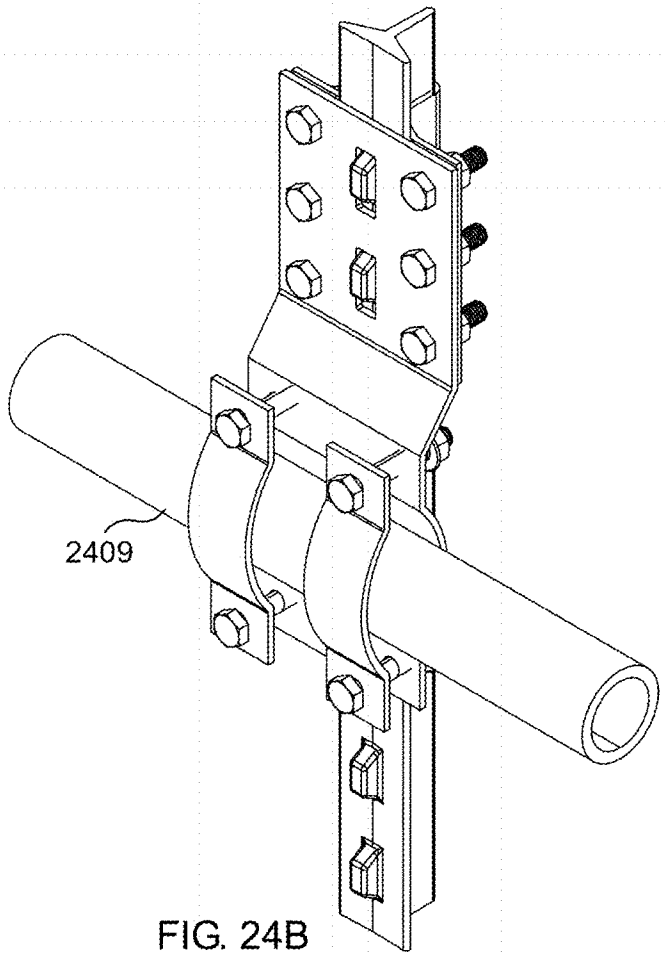
FIG. 24B shows a pipe secured in the modified C-bracket-7 bracing a post.
Figure 24A:
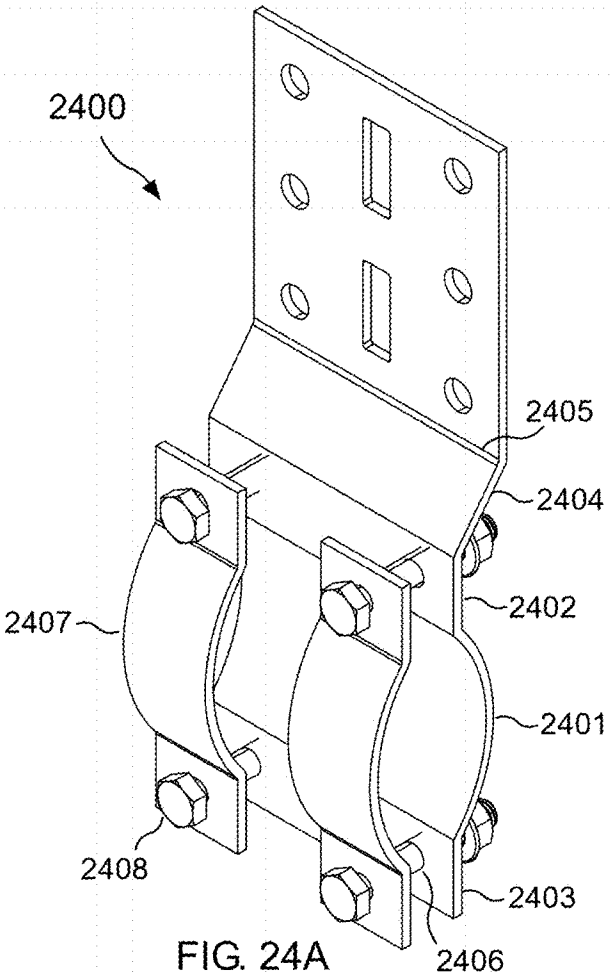
FIG. 24A depicts perspective views of an exemplary modified C-bracket-7 without the sidearms and with extension from a horizontal edge to hold a tubular structure with additional clips fastened to the extension.

FIG. 24A depicts a modified C-bracket-7 2400 without the sidearms and comprising a semicircular extension 2401 with a flat segment 2402 above and a flat segment 2403 below the semicircular region. The flat segment 2402 is contiguous from the lower edge of an offset 2404 extending at an angle from the lower edge 2405 of the said C-bracket 2400. The flat segments 2402 and 2403 have apertures 2406 for fasteners 2408. Metal clips 2407 corresponding in shape to the semicircular extension with flat segments and apertures are applied to secure a tubular structure 2409 in a horizontal position and secured with fasteners 2408 as shown in FIG. 24B.

Although an exemplary system has been described with reference to the FIGS, other implementations may be deployed in other industrial, scientific, medical, commercial, and/or residential applications.

In an illustrative aspect, a post brace bracket may include a butterfly clamp. The butterfly clamp may include a rib-receiving channel configured to receive a first longitudinal rib of a fence post. The fence post may extend along a longitudinal axis. The butterfly clamp may include tabs extending from corresponding proximal edges of the rib-receiving channel and configured to register with a second longitudinal rib of the fence post. The first longitudinal rib and the second longitudinal rib may intersect in a plane orthogonal to the longitudinal axis. The post brace bracket may include a receiver bracket. The receiver bracket may include a first wall including a fastening aperture configured to receive at least one stud extending from a face of the second longitudinal rib. The receiver bracket may include two side walls extending from opposite edges of the first wall and each comprising a coupling aperture configured to releasably couple to a lateral rail. When the butterfly clamp and the receiver bracket are coupled together at either side of the first wall, the fastening aperture may engage the at least one stud to resist translation parallel to the longitudinal axis and the rib-receiving channel may engage the first longitudinal rib to resist rotation about the longitudinal axis.

When the butterfly clamp and the receiver bracket are coupled together, the two side walls may be configured to releasably couple to multiple lateral rails, such that each of the multiple lateral rails extends substantially orthogonally away from the fence post.

The proximal edges of the rib-receiving channel may include an offset bridge connecting a horizontal plane of the tabs and a plane of the proximal edges such that, when the butterfly clamp and the receiver bracket are coupled together to brace a fence post, the offset bridge and the first wall of the receiver bracket create an adaptive space configured to fit multiple shapes of the fence post.

The post brace bracket may include a second receiver bracket coupled to the receiver bracket.

The two side walls may each extend from substantially two-thirds of the corresponding proximal edges of the first wall. The two side walls may include more than one pair of coaxially aligned coupling apertures to releasably couple to a lateral rail.

In an illustrative aspect, a tensioning module may include a channel defining a lumen having an aperture at a distal end and configured to slidingly receive a threaded rod through the channel such that the threaded rod extends along a first longitudinal axis. The tensioning module may include a coupling member at a proximal end configured to couple to a connecting link extending along a second longitudinal axis substantially parallel to the first longitudinal axis. The tensioning module may include a ring gear concentrically and at least partially threadedly coupled to the threaded rod such that, when the ring gear is rotated, the threaded rod is induced to move along the first longitudinal axis. The tension module may include a second gear operably coupled to the ring gear and having an axis of rotation perpendicular to that of the ring gear. The second gear may be configured such that, when the second gear is rotated in a first rotational direction, the second gear induces a rotational motion of the ring gear about the threaded rod such that a position of the threaded rod relative to the tensioning module is altered.

The second gear may include a pinion gear. The second gear may include a worm gear.

The tensioning module may include a lever arm configured to induce rotation of the second gear when the handle is operated by a user. The lever arm and include a handle releasably coupled to the second gear.

The ring gear may be mounted to a housing by at least one rolling bearing.

In some embodiments, the post brace bracket may, for example, include a tensioning module including and at least one coupling module. The coupling modules may, for example, include a combination of more than one clamping modules and/or gear systems.

The coupling member may include a threaded channel configured to receive the connecting link such that a position of the connecting link relative to the channel is adjustable.

In an illustrative aspect, a tensioning module may include a body including a channel defining a lumen having an aperture at a distal end of the body and extending substantially through the body. The channel may be configured to slidingly receive a tension adjusting link through the channel such that the tension adjusting link extends along a first longitudinal axis. Tensioning module may include a coupling feature at a proximal end of the body. The coupling feature may be configured to couple to a connecting link extending along a second longitudinal axis substantially parallel to the first longitudinal axis. Tensioning module may include a tension regulation module configured to selectively engage the tension adjusting link with the tensioning module. The tension regulation module may be selectively operable between: a sliding mode in which the channel is configured to permit the tension adjusting link to slide in the lumen along the first longitudinal axis, and a tension adjusting mode in which the tension regulation module performs tension adjusting operations to the tension adjusting link such that a position of the tension adjusting link relative to the tensioning module is altered such that a tension between a proximal end of the connecting link and a distal end of the tension adjusting link is adjusted.

The tension adjusting link may include a threaded rod. The tension adjusting mode may be a threading mode in which the tension regulation module threadedly engages the threaded rod in the channel. In the tension adjusting mode, the tension adjusting operation may include threadedly couple the threaded rod and the tension regulation module.

The tension regulation module may include a clamping block configured to selectively engage the tension adjusting link. The tension regulation module may include a tension application unit operably coupled to the clamping block such that, when a force perpendicular to the first longitudinal axis is applied, the clamping block engages the tension adjusting link to regulate the position of the tension adjusting link relative to the tensioning module.

The clamping block may include a threaded surface configured to threadedly engage the tension adjusting link.

The clamping block and include an elastomeric end module. The elastomeric end module may be configured with a durometer rating of at least Shore D 60.

The tensioning module may include a locking module. The tensioning module may be further selectively operable in a locking mode in which the locking module clamps the tension adjusting link in a static position relative to the tensioning module.

The coupling feature may include a connecting link receiving end module configured to relieve excess tension to the tensioning module. The coupling feature may include a coil spring.

The tension regulation module may be further configured to selectively engage the connecting link such that a tension of the connecting link and a tension of the tension adjusting link are independently adjustable.

The coupling feature include a threaded channel to receive the connecting link such that a position of the connecting link relative to the channel is adjustable. The tension regulation module may further include a miter gear releasably coupled to the threaded rod.

An illustrative aspect, an adaptable fence bracing rail may include a first rail extending along a first longitudinal axis. The first rail may include a first aperture at a distal end. The first rail may include a first plurality of apertures in a wall of the first rail distributed along at least a portion of the first rail in a first line substantially parallel to the first longitudinal axis. The adaptable fence bracing rail may include a second rail extending along a second longitudinal axis. The second rail may include a second aperture at a distal end. The second row may include a second plurality of apertures in a wall of the second rail distributed along at least a portion of the second rail in a second line substantially parallel to the second longitudinal axis. The first rail and the second rail may be configured such that, when the first rail and the second rail are brought into register such that the first longitudinal axis and the second longitudinal axis are substantially aligned, and at least one coupling member passes through at least one of the first plurality of apertures and at least one of the second plurality of apertures to couple the first rail to the second rail, then the first rail and the second rail are coupled into a field-adjustable bracing rail wherein the distal end of the first rail and the distal end of the second rail form opposite ends of the field-adjustable bracing rail. The field-adjustable bracing rail may be configured to be coupled to a first post by the first aperture and a second post by the second aperture such that the field-adjustable bracing rail resists compressive force induced by motion of the first post and the second post towards each other.

At least one of the first aperture and the second aperture may be configured to couple the corresponding end of the field-adjustable bracing rail to a bracket coupled to a post in a predetermined orientation to the post.

The first plurality of apertures may include slots extending substantially parallel to the first longitudinal axis. The second plurality of apertures may include slots extending substantially orthogonal to the second longitudinal axis.

At least one of the first rail and the second rail may be substantially defined by an L-shaped cross-section. At least one of the first rail and the second rail may be substantially defined by a closed cross-section. The closed cross-section may be substantially rectangular.

At least one of the first rail and the second rail may be configured to slidingly assemble into the other of the first rail and the second rail.

The adaptable fence bracing rail may include a coupling member extending substantially orthogonally from at least one of the first longitudinal axis and the second longitudinal axis. The coupling member may be configured to releasably couple to a diagonal tension member.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A post brace bracket, comprising:

a rib-receiving channel configured to receive a first longitudinal rib of a fence post, wherein the fence post extends along a longitudinal axis; and, tabs extending away in opposing directions of the rib-receiving channel and configured to register with a second longitudinal rib of the fence post, wherein the first longitudinal rib and the second longitudinal rib intersect in a plane orthogonal to the longitudinal axis;

a first wall comprising a fastening aperture configured to receive at least one stud extending from a face of the second longitudinal rib; and, wherein, when each of the tabs are coupled to an opposing first wall, the fastening aperture engages the at least one stud such that the fastening aperture resists translation parallel to the longitudinal axis and the rib-receiving channel engages the first longitudinal rib such that the rib receiving channel resists rotation about the longitudinal axis.

2. The post brace bracket of claim 1, wherein the tabs are coupled together such that the two side walls are configured to releasably couple to multiple lateral rails, such that each of the multiple lateral rails extends substantially orthogonally away from the fence post.

3. The post brace bracket of claim 1, wherein the proximal edges of the rib-receiving channel comprise an offset bridge connecting a horizontal plane of the tabs and a plane of the proximal edges such that, when the tabs are coupled together to brace a fence post, the offset bridge and the first wall of the receiver bracket creates an adaptive space configured to fit multiple shapes of the fence post.

4. The post brace bracket of claim 1, wherein the two side walls each extend from substantially two-thirds of the corresponding proximal edges of the first wall.

5. The post brace bracket of claim 1, wherein the two side walls comprise more than one pair of coaxially aligned coupling apertures to releasably couple to a lateral rail.

6. The post brace bracket of claim 1, further comprising a butterfly clamp.

7. The post brace bracket of claim 1, wherein the tabs extend from corresponding proximal edges of the rib-receiving channel.

8. The post brace bracket of claim 1, further comprising a receiver bracket.

9. The post bracket of claim 1, further comprising two side walls extending from opposite edges of the first wall and each comprising a coupling aperture configured to releasably couple to a lateral rail.

10. The post brace bracket of claim 1, further comprising a C-bracket with L-shaped sidearms having apertures for fasteners.

11. The post brace bracket of claim 1, further comprising a C-bracket comprising a U-shaped extension from a horizontal edge of the C-bracket, configured to secure planks or other block materials configured with apertures to receive fasteners.

12. The post brace bracket of claim 1, further comprising sidearms configured to attach accessories to a C-bracket.

13. The post brace bracket of claim 1, further comprising a C-bracket with a rooftop plate configured to receive accessories.

14. The post brace bracket of claim 1, further comprising a C-bracket with at least one sidearm configured to receive an axle of a hinge configured for a frame.

15. The post brace bracket of claim 1, further comprising a C-bracket with sidearms comprising apertures along a horizontal axis configured to receive U-bolts.

16. The post brace bracket of claim 15, wherein the U-bolts are configured to secure tubular structures or cylindrical objects to the C-bracket.

17. The post brace bracket of claim 1, further comprising a C-bracket with a U-shaped extension from a horizontal edge, configured to hold wood planks or other block materials.

18. The post brace bracket of claim 17, wherein the U-shaped extension includes apertures configured to secure the materials with fasteners.

19. The post brace bracket of claim 1, a C-bracket configured to support an L-shaped piece with a short base plate that attaches to the C-bracket.

20. The post brace bracket of claim 1, further comprising a sidearm of a L-shaped piece extending to a base plate.

21. The post brace bracket of claim 1, further comprising a C-bracket having a curvilinear extension configured to releasably couple to a tubular structure.

22. The post brace bracket of claim 1, further comprising a tensioning module comprising:

at least one clamping module block configured to selectively engage a tension adjusting link; and, at least one tensioning link comprising:

a body comprising a channel defining a lumen having an aperture at a distal end of the body and extending substantially through the body, wherein the channel is configured to slidingly receive a tension adjusting link through the channel such that the tension adjusting link extends along a first longitudinal axis;

a coupling feature at a proximal end of the body, the coupling feature configured to couple to a connecting link extending along a second longitudinal axis substantially parallel to the first longitudinal axis; and, a tension regulation module configured to selectively engage the tension adjusting link with the tensioning module, wherein the tension regulation module is selectively operable between:

a sliding mode in which the channel is configured to permit the tension adjusting link to slide in the lumen along the first longitudinal axis, and a tension adjusting mode in which the tension regulation module performs tension adjusting operations to the tension adjusting link such that a position of the tension adjusting link relative to the tensioning module is altered such that a tension between a proximal end of the connecting link and a distal end of the tension adjusting link is adjusted.

23. The post brace bracket of claim 1, further comprising a tensioning module comprising:

at least one tensioning link comprising:

a body comprising a channel defining a lumen having an aperture at a distal end of the body and extending substantially through the body, wherein the channel is configured to slidingly receive a tension adjusting link through the channel such that the tension adjusting link extends along a first longitudinal axis;

a coupling feature at a proximal end of the body, the coupling feature configured to couple to a connecting link extending along a second longitudinal axis substantially parallel to the first longitudinal axis; and, a tension regulation module configured to selectively engage the tension adjusting link with the tensioning module, wherein the tension regulation module is selectively operable between:

a sliding mode in which the channel is configured to permit the tension adjusting link to slide in the lumen along the first longitudinal axis, and a tension adjusting mode in which the tension regulation module performs tension adjusting operations to the tension adjusting link such that a position of the tension adjusting link relative to the tensioning module is altered such that a tension between a proximal end of the connecting link and a distal end of the tension adjusting link is adjusted; and at least one gear system module comprising:

a channel defining a lumen having an aperture at a distal end and configured to slidingly receive a threaded rod through the channel such that the threaded rod extends along a first longitudinal axis;

a coupling member at a proximal end configured to couple to a connecting link extending along a second longitudinal axis substantially parallel to the first longitudinal axis;

a ring gear concentrically and at least partially threadedly coupled to the threaded rod such that, when the ring gear is rotated, the threaded rod is induced to move along the first longitudinal axis; and, a second gear operably coupled to the ring gear such that, when the second gear is rotated, the second gear induces a rotational motion of the ring gear about the threaded rod such that a position of the threaded rod relative to the tensioning module is altered.

* * * * *